US005714805A

United States Patent [19]

Lobaugh

[11] Patent Number: 5,714,805

[45] Date of Patent: Feb. 3, 1998

[54] VEHICLE ACCESSORY POWER TAKE-OFF SYSTEM INCLUDING PHONO/RCA TYPE PLUG AND JACK FOR USE WITH CIGARETTE LIGHTER PLUG/JACK

[75] Inventor: Jack L. Lobaugh, Hermiston, Oreg.

[73] Assignees: Brian J. Lobaugh; Vivian E. Kalal; Robert H. Lobaugh; Karen Lobaugh; Beverly R. Teeples, Hermiston, Oreg.

[21] Appl. No.: 608,182

[22] Filed: Feb. 28, 1996

[51] Int. Cl.[6] ..... H01R 33/00

[52] U.S. Cl. ..... 307/10.1; 439/34; 439/638

[58] Field of Search ..... 307/9.1, 10.1, 307/10.7, 43; 320/2; 280/DIG. 14; 219/262, 267, 268, 202, 211; 180/53.5, 53.6; 439/34–36, 638, 651, 639, 652, 668, 669

[56] References Cited

U.S. PATENT DOCUMENTS

| | | | |
|---|---|---|---|
| 4,319,798 | 3/1982 | Mittelhäuser | 439/638 |
| 4,638,728 | 1/1987 | Elenewski | 219/211 |
| 5,217,395 | 6/1993 | Bailey et al. | 439/668 |
| 5,326,283 | 7/1994 | Chen | 439/638 |
| 5,431,585 | 7/1995 | Fan | 439/34 |
| 5,510,691 | 4/1996 | Palatov | 320/2 |

*Primary Examiner*—Richard T. Elms

*Attorney, Agent, or Firm*—Floyd E. Ivey

[57] ABSTRACT

A system or method of providing a plurality of power take-offs or power interfaces for low amperage electrical portable work and entertainment devices, including 6 or 12 volt direct current devices directed in particular to the power take-off in automotive vehicles, including but not limited to automobiles, trucks, boats and airplanes, providing power to portable work and entertainment devices such as portable televisions, cellular telephones, computers and other such devices. The improved system or method provides a plurality of receptacles, an electrical connector of a size which is more convenient than the connector accommodated by the vehicle cigarette lighter receptacle, and which is of such structural integrity as to resist deterioration or breaking of wiring. The improvement is particularly directed to the elimination, replacement or substitution of the presently existing standard cigarette lighter receptacle and thus the elimination of the size-linked encumbrance of existing cigarette lighter electrical connections. The facility by which the desired increase in the number and location versatility of receptacles per vehicle can be provided is by allowing the size of the plug and receptacle interface to be reduced though the employment of phono-type plug and jack (RCA plug and jack) electrical connectors in replacement of the present cigarette lighter or pseudo cigarette lighter receptacles and connectors.

4 Claims, 14 Drawing Sheets

1A
2
48A
45B
44
38
50A
48E
48
50
1A
2
48A
45B 50C
44
48B
37
38
45
48
48D
50
46
32E
45A
50A
14
15A
15B
33
15
13
20
11
11C
9B
9F
23
19
26
11D
18
24
25
8
32D
7
29A
29
9E
9
9A
9C
4
2
2
2A
3
7
6
5
5A
1A
4A
4
3A
11B
2C
7A
3B
23A
18
18A
32A
50B
8
17
9D
23C
11A
28
9G
56
52
4B
15C
34
1
39
34A
50D
32
39
41
40
48C
5
5

13F
14D
13D
14A
14
15C
15A
15B
15L
14B
15N
15M
15J
15F
15D
15A
13A
13B
13
13B
14C
15D
13C
51
56
15I
11E
15P
13E
15
15G
15E
9F
15K
11

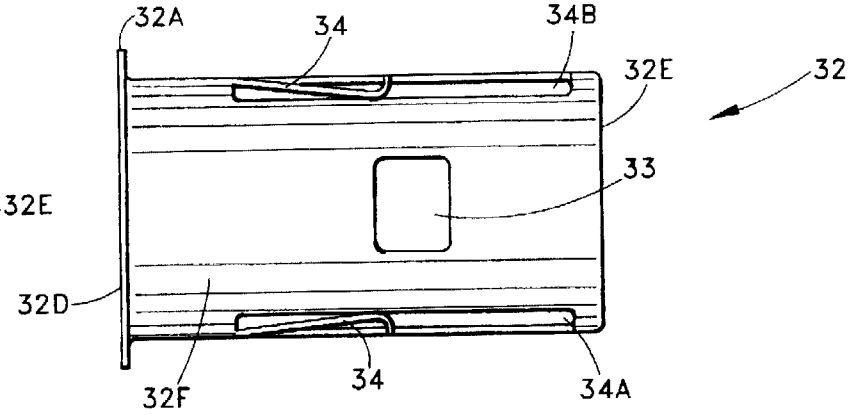
Fig. 3A
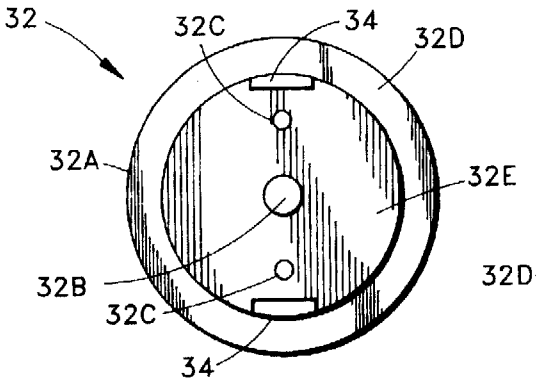
Fig. 3B
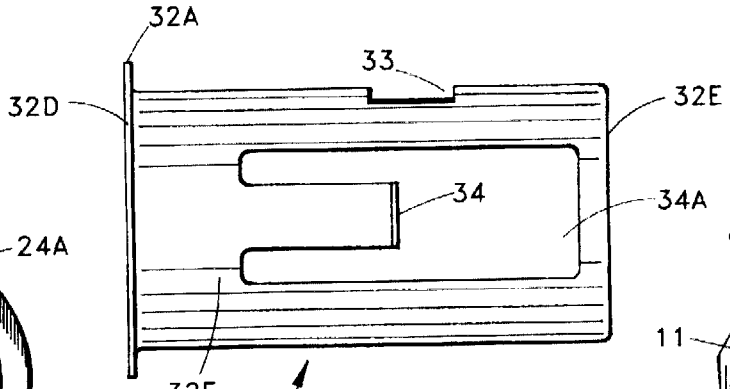
Fig. 3
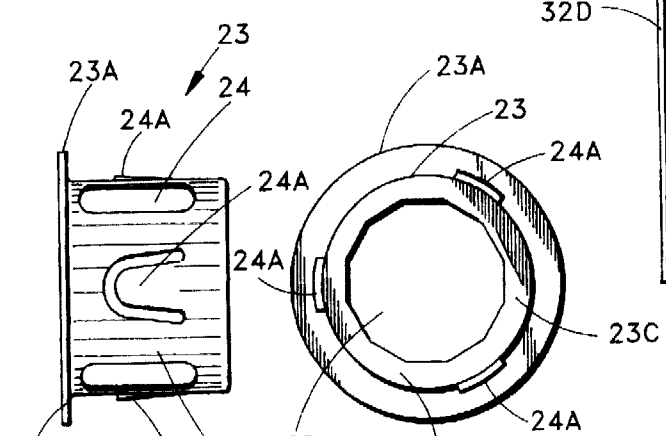
Fig. 4A
Fig. 4
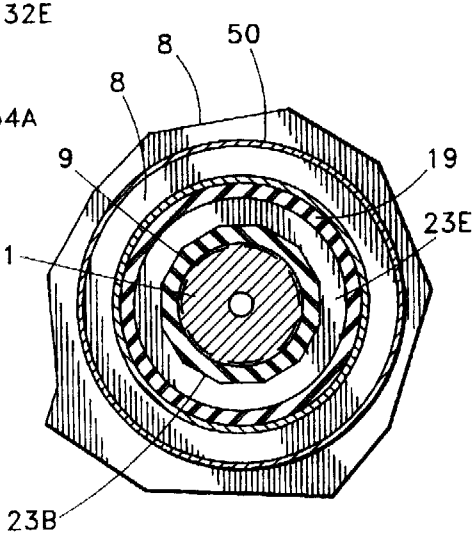
Fig. 5

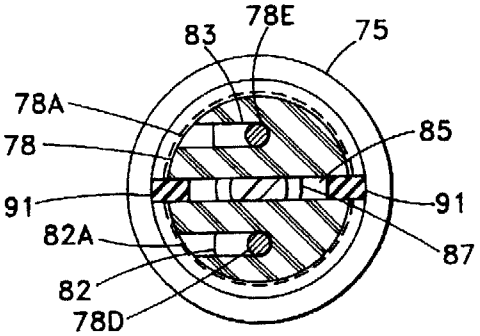
Fig. 21A
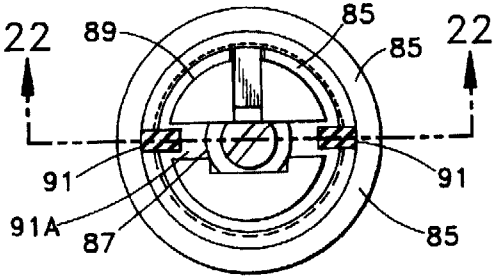
Fig. 21B
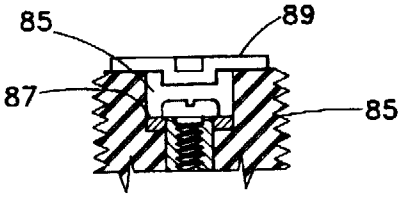
Fig. 22
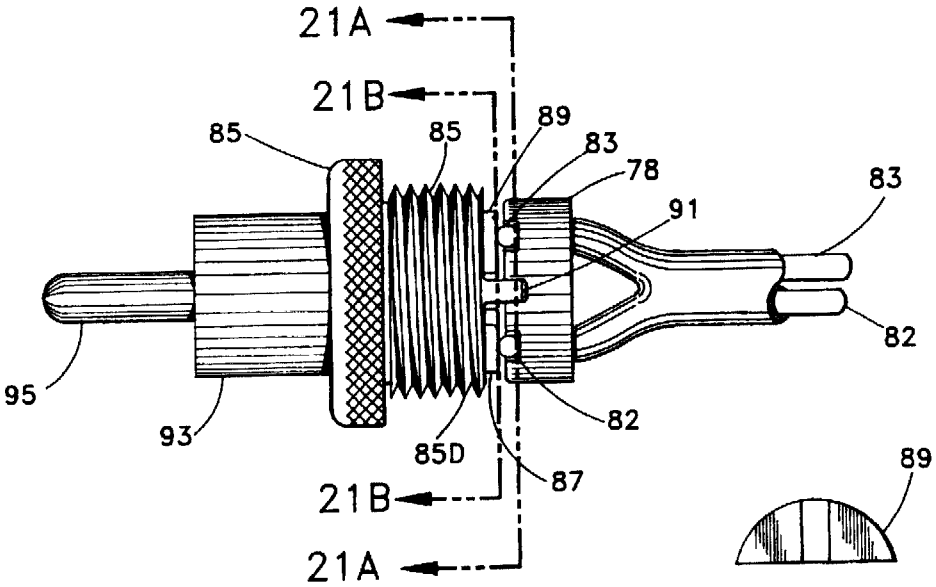
Fig. 21
Fig. 23
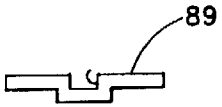
Fig. 23A
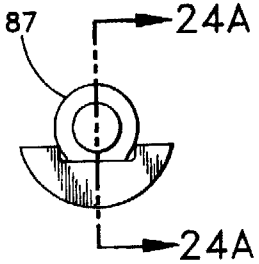
Fig. 24
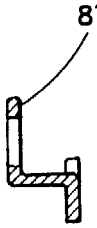
Fig. 24A

VEHICLE ACCESSORY POWER TAKE-OFF SYSTEM INCLUDING PHONO/RCA TYPE PLUG AND JACK FOR USE WITH CIGARETTE LIGHTER PLUG/JACK

FIELD OF THE INVENTION

The present invention relates generally to power take-offs or power interfaces for low amperage portable work and entertainment devices, including, but not limited to, 6 or 12 volt direct current devices, and in particular to a power take-off in automotive vehicles, including but not limited to automobiles, trucks, boats and airplanes, providing power to portable work and entertainment devices such as portable televisions, cellular telephones, computers and other such devices.

BACKGROUND OF THE INVENTION

An ever greater number of electrically powered devices are operated from within automotive vehicles. Portable CD players and cellular telephones have been commonly operated and powered from a connection with an automotive vehicle cigarette lighter receptacle. Such portable devices are equipped with an electrical plug designed to connect with a vehicle's cigarette lighter receptacle or cigarette lighter type power receptacle. The number and accessibility of such receptacles in today's vehicles is generally limited requiring the operator to connect devices to the various single cigarette lighter receptacles in the vehicle, which in most vehicles is limited to one receptacle. The connections may thus involve limited access to a single receptacle, or in the case of multiple receptacles, the inconvenience of electric cords stringing from devices to the driver's and rear passengers' areas. The proliferation in the number of such devices now available to the consumer and intended to be operated within automotive vehicles has created a need for an increase in the number, type and location versatility of power receptacles available.

SUMMARY OF THE INVENTION

In accordance with the present invention, an improvement in the system of interfacing low amperage powered portable work and entertainment devices, including, but not limited to, 6 or 12 volt direct current devices, is provided. The present invention comprises an improvement to known power interfacing systems, including typical automotive vehicle cigarette lighters, by providing for a plurality of receptacles, an electrical connector of a size which is more convenient than the connector accommodated by the vehicle cigarette lighter receptacle, and which is of such structural integrity as to resist deterioration or breaking of wiring.

The improvement is particularly directed to the elimination, replacement or substitution of the presently existing standard cigarette lighter receptacle and thus the elimination of the size-linked encumbrance of existing cigarette lighter electrical connections. The facility by which the desired increase in the number and location versatility of receptacles per vehicle can be provided is by allowing the size of the plug and receptacle interface to be reduced though the employment of phono-type plug and jack (also known as RCA plug and jack) electrical connectors in replacement of the present cigarette lighter or pseudo cigarette lighter receptacles and connectors. The possible use of other smaller type plug and jack electrical connectors including phone-type and mini two-pronged plugs and jacks is recognized. However, the preferred embodiment of the present invention employs phono-type plugs and jacks as less susceptible to accidental shorting from adult or child user accident or abuse than phone type plugs and jacks and non-susceptible to potentially device harmful polarity misconnections inherent in a two-pronged plug and jack system.

The present invention is an improved apparatus of connecting electrical and electronic devices to a vehicle's direct current electrical system by using smaller connective jacks and plugs resulting in economical, environmental and space savings, aesthetic enhancement, better placement versatility and greater convenience in adding a multiplicity of connections over that which can be realized through the continued employment of the present system.

The invention disclosed is comprised of four components including 1) a combination phono-jack type power take-off and cigarette lighter with a receptacle of special design. This format provides for the continued presence of a functioning cigarette lighter combined with a power take-off feature when used with its specially designed receptacle and as a power take-off only when adapted by use of the faux cigarette lighter element for use in cigarette lighter receptacles currently in use in vehicles; 2) a self-fused, multi-receptacle junction box which can be mounted as an after-market installation within the vehicle in a location selected by the operator. The junction box can be connected to the vehicle's power supply via an extension cord connection to the combination phono-jack type power take-off, cigarette lighter of format 1) or can be independently connected directly to an appropriate power supply source within the vehicle; 3) a multi-receptacle non self-fused junction box of format 2) which is installed by a vehicle manufacturer as a part of the vehicle original equipment; and 4) quick-connect phono-type plug which is easily connected to the power cord of any portable electrical or electronic device by the consumer or original manufacturer in replacement of or as an alternative to the presently used cigarette lighter-type electrical connector. The phono-type plug connector developed herein, rather than the smaller, more fragile phono, phone and other type plugs and jacks currently available, provides the sturdiness required by the frequency of connection/disconnection experienced in the ordinary use of devices addressed by this invention as well as an easier and more positive method of consumer connection of the phono plug with the power cords of such devices. In addition, the phono type plug developed herein is handily reusable.

The handle of a cigarette lighter, of the design of format 1), distal from the receptacle accommodates a power take-off supply of up to 25 amperes direct current, when using AWG No. 12 gauge wiring, for supply to the multiple-receptacle junction box of format 2). Power to the multiple-receptacle junction box is routed via an extension cord or patch-cord connection to the power take-off or by permanent and direct wiring to the vehicle power system. The maximum current available will be limited, in the self-fused multiple-receptacle junction box of format 2), to the capacity of the extension cord used.

This disclosure offers aesthetic and functional advantages not permitted by the apparatus configuration presently employed by both vehicle and after-market manufacturers. This invention provides ecological benefits through its use of fewer physical resources in producing a similar number of additional electrical connections over that required when employing the present standard connector system and through its use of reusable quick-connect phono type plugs. The phono-jacks on the combination power take-off/cigarette lighter and the junction boxes are inherently more difficult for a child to probe than the current standard receptacle and additionally can be plugged by an appropriate cover or cap when not in use.

BRIEF DESCRIPTION OF THE DRAWINGS

The foregoing and other features and advantages of the present invention will become more readily appreciated as the same become better understood by reference to the following detailed description of the preferred embodiment of the invention when taken in conjunction with the accompanying drawings, wherein:

FIG. 3 is a side elevation view of the Vehicle Accessory Power Take-Off/Cigarette Lighter Receptacle 32.

FIG. 3A is a side elevation view of the Vehicle Accessory Power Take-Off/Cigarette Lighter rotated axially 90 degrees to the right(as viewed from the top) from FIG. 3.

FIG. 3B is a top view of the Vehicle Accessory Power Take-Off/Cigarette Lighter Receptacle 32.

FIG. 4 is a side elevation view of the Spring retainer case 23.

FIG. 4A is a bottom view of the spring retainer case 23.

FIG. 5 is a bottom view of the spring retainer case 23 and a section view, taken through 5—5 of FIG. 1A, of the Element Carrier 9, the Phono Connector Assembly 4, and the Element Head Connector No. 1 and Slip Ring 11 showing the Element Carrier Aperture (in the preferred embodiment being a dodecagon or 12 sided aperture) 23B which restrains the dodecagon sided Element Carrier 9 from turning when the Cigarette Lighter Element Head Connector No. 1 and Slip Ring 11 is changed to the Element Head Connector No. 2 and Faux Element Head Assembly 60 or vice-versa.

FIG. 21 is a plan view of the quick-connect phono-type plug's Main Body, Clamping Plate and Power Cord showing a detail of knurling on Main Body for ease of connecting and disconnecting the plug to and from the Power Cord.

FIG. 21A is a section view of the quick-connect phono-type plug taken at 21A—21A of FIG. 21.

FIG. 21B is a section view of the quick-connect phono-type plug taken at 21B—21B of FIG. 21.

FIG. 22 is a section view of the quick-connect phono-type plug taken through 22—22 of FIG. 21B to show detail of the connection of ground contact plate 89 with phono connector female ground clip extension 94 and of the connection of positive contact plate 87 with phono connector positive pin 95 and positive pin retainer screw 96.

FIG. 23 is a bottom plan view of the quick-connect phono-type plug's negative contact plate.

FIG. 23A is a front elevation view of the quick-connect phono-type plug's negative contact plate.

FIG. 24 is a bottom plan view of the quick-connect phono-type plug's positive contact plate.

FIG. 24A is a section view of the quick-connect phono-type plug's positive contact plate taken through 24A—24A of FIG. 24.

DETAILED DESCRIPTION

Figures 1, 1A, 1B:
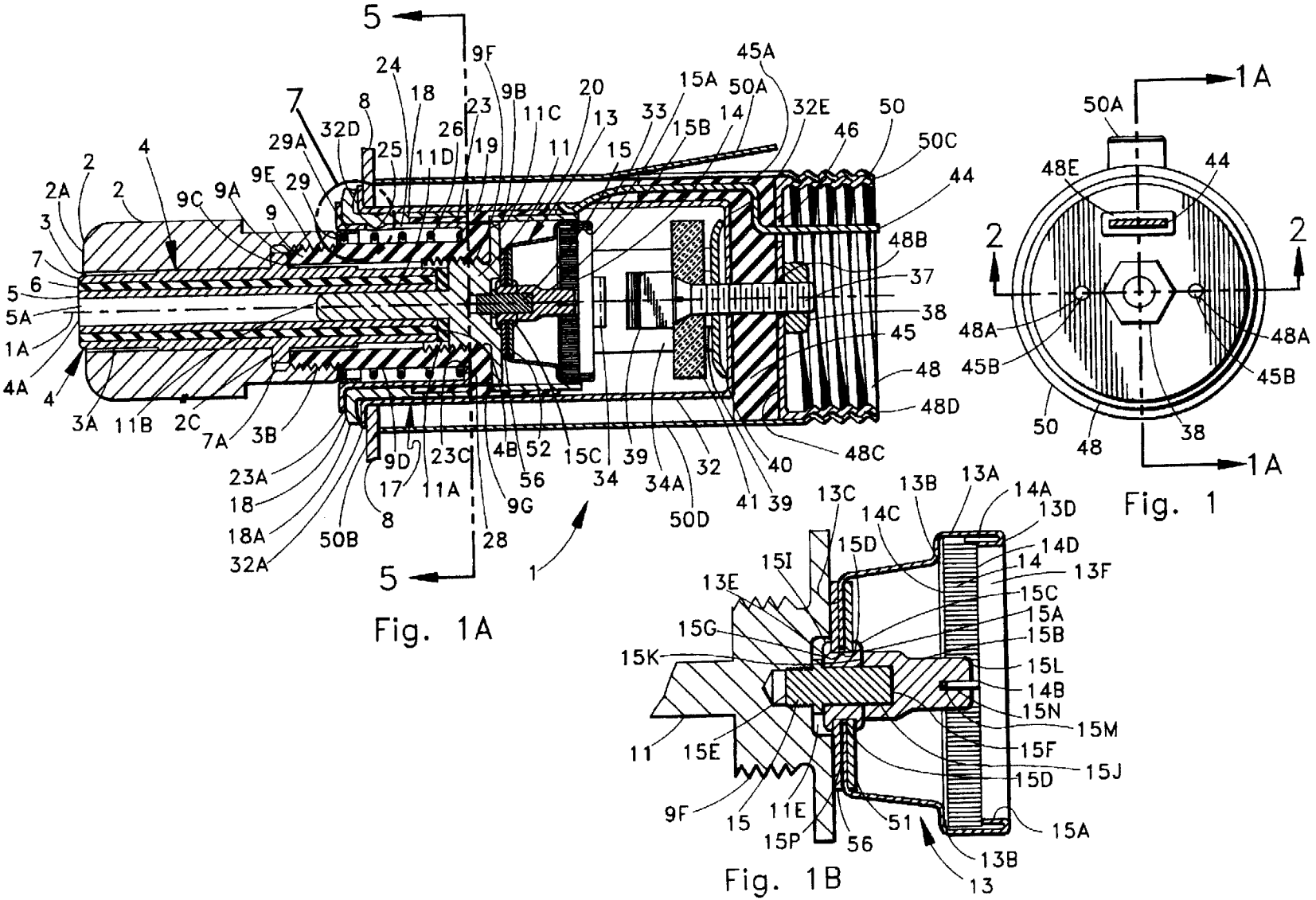
FIG. 1 is a bottom view of the Vehicle Accessory Power Take-Off/Cigarette Lighter.
FIG. 1A is a section view of the Vehicle Accessory Power Take-Off/Cigarette Lighter in the open position taken through 1A—1A of FIG. 1.
FIG. 1B is a section view of the element head assembly and portion of the element head connector No. 1 and slip ring taken through 1A—1A of FIG. 1.

The Vehicle Accessory Power Take-Off System components and operation are described in the following subsections.

I. VEHICLE ACCESSORY POWER TAKE-OFF/ CIGARETTE LIGHTER

Handle and Phono Connector Assembly

FIG. 1 through FIG. 11A illustrates the Vehicle Accessory Power Take-Off/Cigarette Lighter 1 being female electrical connector means shown herein for example has a longitudinal axis 1A. Handle means provided herein by a handle 2 having a handle first and second end 2A, 2B with the longitudinal axis 1A extending through the center of the handle first end 2A toward and through the center of the handle second end 2B.

Positive and negative electrical bias connector means, provided by example herein, by a Phone-plug Female Clip Aperture 3 having a Phone-plug Female Clip Aperture Wall 3A which extends through the handle 2 from said handle first end toward the handle second end 2A, 2B centered along the longitudinal axis 1A. A Phone Connector Assembly 4 having a Phone Connector Assembly First and Second End 4A, 4B received into the Phone-Plug Female Clip Aperture 3 and comprised of the essentially cylindrical components concentrically arranged from inside to outside of an electrically conductive Phone Connector Positive Element 5, an electrically nonconductive Phone Connector Insulator 6 and an electrically conductive Phone Connector Ground Element 7. The Phone Connector Positive Element 5 having a Phone Connector Positive Element Bore 5A centrally located therein along the longitudinal axis 1A. A portion of the Phone Connector Ground Element 7 proximal to the handle first end 2A has an outside diameter less than the inside diameter of the Phone-Plug Female Clip Aperture 3 of a dimension which will allow the insertion of the Female Clip of the Quick Connect Phone Type Plug 74 to be in electrical continuity with the Phone Connector Assembly 4.

Element Carrier and assembly supporting Lighter Resistance Element

Lighter resistance element means and structure means to physically and electrically connect with handle means provided herein by an Element Carrier, Element Head connector No. 1 and Slip Ring, and Element Head Assembly as follows:

1. Element Carrier

An Element Carrier 9 has an Element Carrier First End and Second End 9A, 9B with an Element Carrier Aperture 9C centrally positioned and penetrating the Element Carrier 9 from the Element Carrier First to Second End 9A, 9B forming a substantially cylindrical interior shape and a dodecagonal(12 sided) exterior shape forming an Element Carrier Outer Surface 9D. The Element Carrier First End 9A received into the Phono-Plug Female Clip Aperture 3 proximal to the handle second end 2B so that the Element Carrier Aperture 9C is concentric in relation to the Longitudinal Axis 1A. The width of the Element Carrier 9, proximal to the Element Carrier Second End, across a plane orthogonal to the longitudinal axis 1 is greater than the width of the Element Carrier 9 proximal to the Element Carrier First End 9A forming intermediate the Element Carrier First and Second Ends 9A, 9B a Element Carrier Shoulder 9G.

The inside diameter of the Element Carrier Aperture 9C is greater than the outside diameter of the Phono Connector Ground Element 7. The Phono-plug Female Clip Aperture Wall 3A proximal to the Handle Second End 2B having aperture securing means 3B including but not limited to friction, screw and threaded means to accept Element Carrier Securing means 9E on the Element Carrier Outer Surface 9D proximal to the Element Carrier First End including but not limited to friction, screw and threaded means. The Phono-plug Female Clip Aperture Wall 3A having a circumferential Notch 2C therein intermediary between Aperture Securing Means 3B and the Handle First End 2A. The Phono Connector Ground Element 7 having a circumferential Phono Connector Ground Element Shoulder 7A which is encountered and secured between the Notch 2C and the Element Carrier First End 9A when the Aperture Securing Means 3B and Element Carrier Securing means 9E are positioned together establishing the operational relationship of the Handle 2, Phono connector Assembly 4 and Element Carrier 9.

2. Element Head Connector No. 1 and Slip Ring

An Element head Connector No. 1 and Slip Ring 11 having a No. 1 First and Second End 11B, 11C and a No. 1 Surface 11D and being substantially circular in cross-section around an axis centrally located through the No. 1 First and Second Ends 11B, 11C. The Element Head Connector No. 1 and Slip Ring 11 having an outside diameter proximal to the No. 1 First End 11b so the No. 1 First End 11B is received into and is in electrical conductivity with the Phono Connector Positive Element Bore 5A.

The diameter of the Element Head Connector No. 1 and Slip Ring 11 intermediate the No. 1 First and Second Ends 11B, 11C having an outside diameter and No. 1 Mating means including but not limited to friction, screw and threaded means such as to be received at the Element Carrier Second End 9B into the Element Carrier Aperture 9C and secured by Element Carrier Aperture Mating means 9F including but not limited to friction, screw and threaded means. An Element Head Connector Insulating Washer 11A or insulating means secured between the Phone connector Assembly Second End 4B and the Element Head Connector No. 1 and Slip Ring 11 when the Phone Connector Assembly 4, the Element Carrier 9 and Element Head Connector No. 1 and Slip Ring 11 are positioned and secured by the connected No. 1 Mating Means 11F and Element Carrier Aperture Mating means 9F.

The surface of the No. 1 Second End 11C is substantially flat and has a No. 1 Second End void 11E centrally located therein. The longitudinal axis 1A passes through the center of No. 1 First and Second Ends 11B, 11C when the Element Head Connector No. 1 and Slip Ring 11 is operationally positioned.

3. Element Head Assembly

Figure 2:
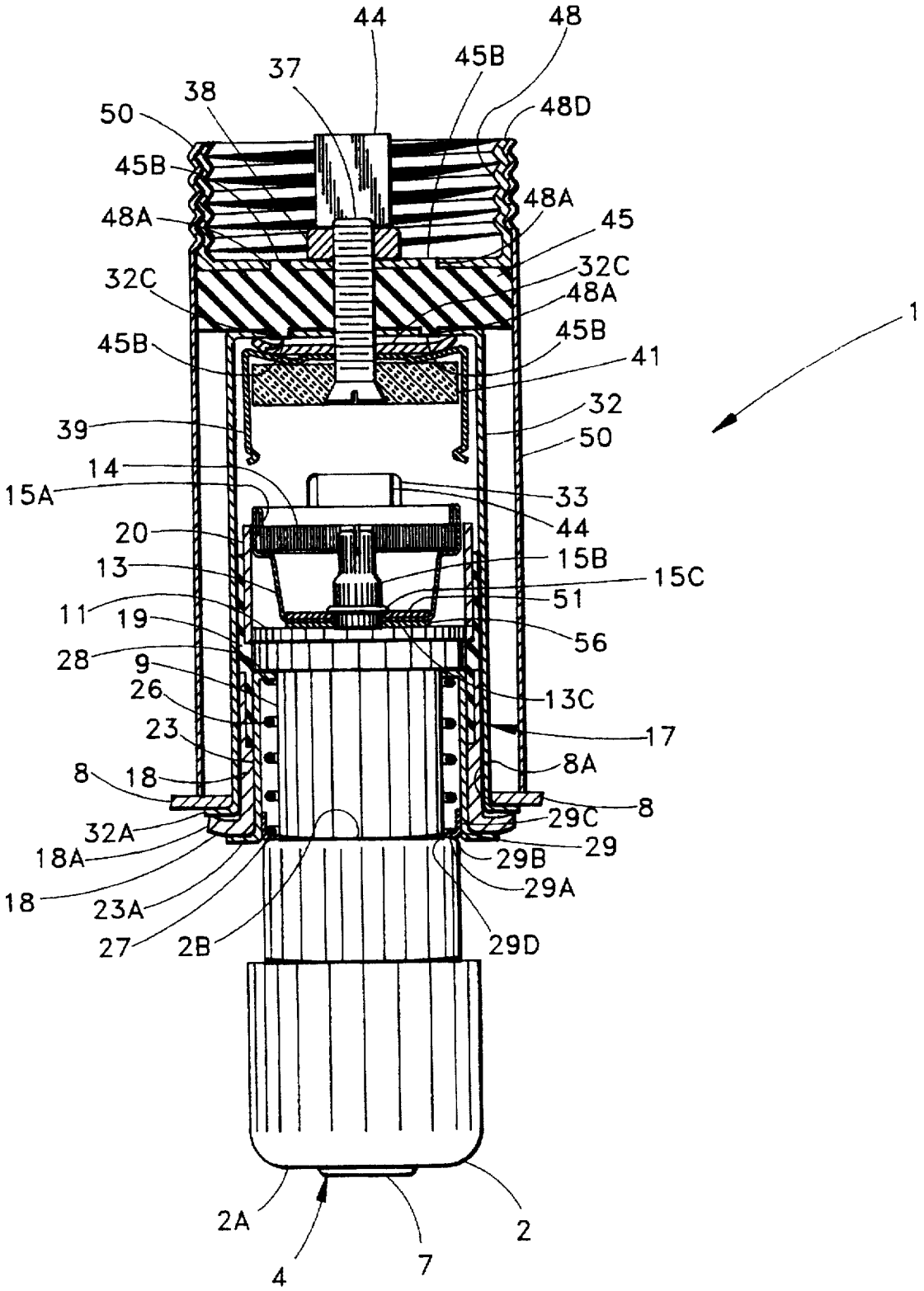
FIG. 2 is a section view of the Vehicle Accessory Power Take-Off/Cigarette Lighter in the open position taken through 2—2 of FIG. 1.

An Element Head Assembly 13 embraces a heating means which may include a resistance heating coil and is formed of an Element Head Case 13A which in the open position of the Vehicle Accessory Power Take-Off/Cigarette Lighter 1, as demonstrated in FIGS. 1A and 2, is at the same electrical potential as the Element Head connector No. 1 and Slip Ring 11 and in the closed position is at ground potential opposing the positive potential of the Element Head Connector No. 1 and Slip Ring 11. The Element Head Case 13A contains a Lighter Resistance Element 14 which is a heating means such as a resistance heating coil or heating element having a Lighter Resistance Element First and Second End 14A, 14B. The Lighter Resistance Element 14 is positioned within the Element Head Case 13A so as to be electrically resistive between positive and negative potentials when closed.

The structure of the Element Head Assembly 13 provides electrically insulating means to insulate the Element Head Case 13A from the positive potential of the Element Hear Connector No. 1 and Slip Ring 11. The structure providing this insulating means also supports the Element Head Case 13A and provides the electrical path which permits the electrical biasing of the Lighter Resistance Element 14. Structure and insulating means fulfills this function which is provided in this embodiment by an Element Head Retaining Pin 15 having an Element Head Retaining Pin First and Second End 15E, 15F with the Element Head Retaining Pin First End 15E received by securing means which may include but not be limited to friction, screw and threaded means into No. 1 Second End void 11E. A portion of the Element Head Retaining Pin 15 proximal to the Element Head Retaining Pin First End 15E in this embodiment is threaded to match threaded means provided by the No. 1 Second End Void 11E.

An Element Head Case To Element Head Retaining Pin Fastener 15C has an Element Head Case To Element Head Retaining Pin Fastener First and Second Side 15G, 15H and Edge 15I. An aperture penetrating from the Element Head Retaining Pin Fastener First to Second Side 15G, 15H forms a Element Head Retaining Pin Aperture 15J through which is received the Element Head Retaining Pin Second End 15F and by securing means including but not limited to press fit, friction, screw and threaded means secures the Element Head Retaining Pin 15 therein.

A Resistance Element Retaining Pin and Positive Contact Point 15B has a Resistance Element Retaining Pin and Positive Contact Point First and Second End 15K, 15L with the Resistance Element Retaining Pin and Positive Contact Point First End 15K having a Resistance Element Retaining Pin and Positive Contact Point First End Void 15M through which is received the Element Head Retaining Pin Second End 15F and by securing means including but not limited to press fit, friction, screw and threaded means secures the Element Head Retaining Pin 15 therein. The Resistance Element Retaining Pin and Positive Contact Point Second End 15L has a Resistance Element Retaining Pin and Positive Contact Point Second End Notch 15N which receives and secures by means including but not limited to press fit and friction the Lighter Resistance Element Second End 14B.

The Element Head Case 13A has an Element Head Case First and Second Side 13C, 13D. The Element Head Case First and Second Sides 13C, 13D have respectively an Element Head Case First and Second Side Apertures 13E, 13F. The circumference of the Element Head Case to Element Head Retaining Pin Fastener 15C is formed by the Element Head Case to Element Head Retaining Pin Fastener Edge 15I which has a circumferential groove therein in the form of an Element Head Retaining Pin Fastener Edge Groove 15P. Element Head Case Insulating Washer No. 1 and No. 2 51, 56 are composed of electrical insulating material and are in a washer configuration being substantially disk shaped with an aperture therein. The assembly of the Element Head Assembly 13 is concluded in part by sandwiching the Element Head Case First Side 13C between the Element Head Case Insulating Washers No. 1 and No. 2 51, 56 with an alignment of Element Head Case Insulating Washers No. 1 and No. 2 apertures with the Element Head Case First Side Surface Aperture 13E through which the structure of the assembled Element Head Retaining Pin 15, Element Head Case to Element Head Retaining Pin Fastener 15C and Resistance Element Retaining Pin and Positive Contact Point 15B is inserted so that the Element Head Retaining Pin Fastener Edge Groove 15P is aligned with the sandwich of Element Head Case First Side 13C between insulating washers, shown here by example as Element Head Case Insulating Washers No. 1 and No. 2 51, 56 wherein the sandwiched configuration will be received into and fastened by means including press fit or friction into the Element Head Retaining Pin Fastener Edge Groove 15P. The sandwich of Element Head Case First Side 13C between the Element Head Case Insulating Washers No. 1 and No. 2 51, 56 is arranged so that the diameter of the Element Head Case First Side Aperture 13E is greater than the apertures of the Element Head Case Insulating Washers No. 1 and No. 2 51, 56 so that an insulating air gap, shown as an Air Gap Insulator Between Element Head Case and Retaining Pin Fastener 15D, is formed between the Element Head Case 13A and the Element Head Case to Element Head Retaining Pin Fastener 15C.

The Element Head Case Second Side 13D proximal to the Element Head Case Second Side aperture 13F is folded in to form a Resistance Element Retaining Lip 15A which provides grasping means to receive and secure the Lighter Resistance Element 14 proximal to the Lighter Resistance Element First End 14A substantially enclosing the first resistance coil forming the outer perimeter of the Lighter Resistance Element 14. The Lighter Resistance Element 14 having an Element Back Side 14C and a Heater Element Side 14D. The Heater Element Side 14D is proximal to the Element Head Case Second Side 13D and the Element Head Case Second Aperture 13F and provides the cigarette lighter function. The Element Head Case 13A enclosing the Lighter Resistance Element 14 with a space therein as the Air Gap Insulator Between Element Head Case and Lighter Resistance Element 13B electrically separating the Element Back Side 14C from The Element Head Case First Side 13C.

Spring And element Carrier Case Assembly

Figure 7:
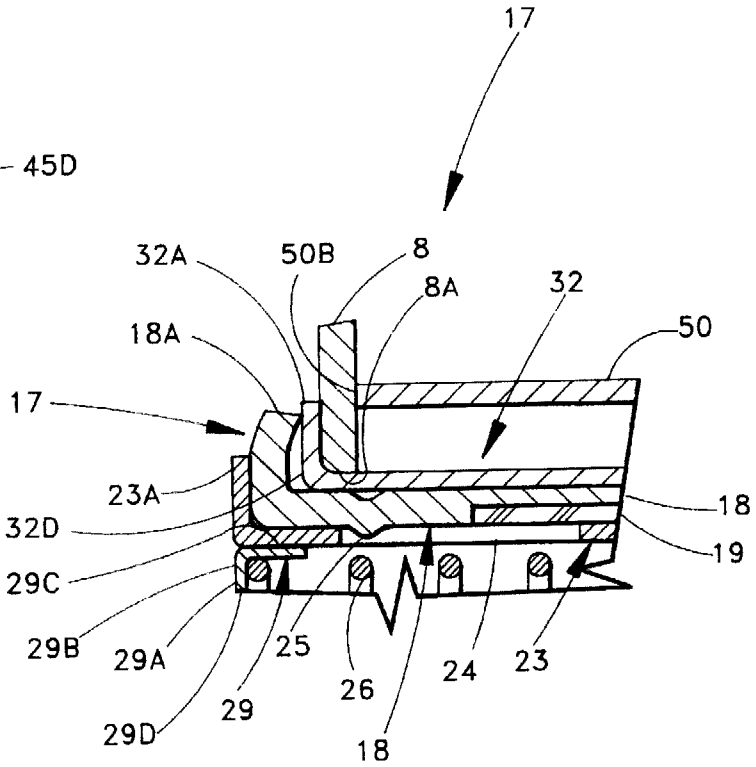
FIG. 7 is a detail showing a portion of the Vehicle Accessory Power Take-Off/Cigarette lighter Receptacle 32, the Spring and Element Carrier Case Assembly 17, the Spring Retainer Case 23, the Top Spring Retaining Cap 29, and the Spring 26 taken at 7 of FIG. 1A, to illustrate the relationship of the Spring and Element Carrier Case Retaining Dimples 25 in the Spring and Element Carrier Case 18 to the Spring Retaining Case Retaining Slot 24.
Figure 6A:
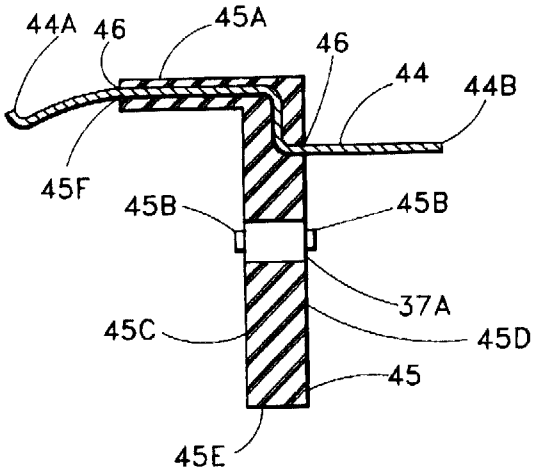
FIG. 6A is a section view of the Positive Lead retainer/insulator 45, the Positive Lead Retainer/Insulator Extension 45A and of the positive lead 44 taken through 6A—6A of FIG. 6.
Figure 6:
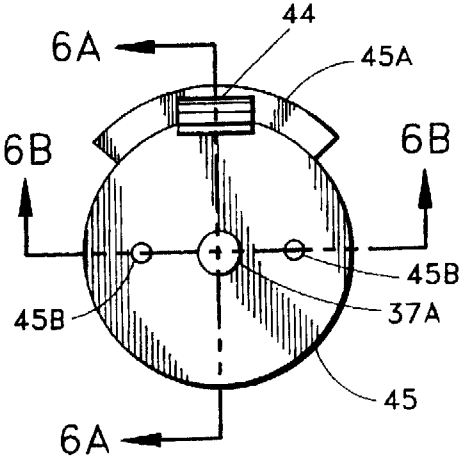
FIG. 6 is a top view of the Positive Lead Retainer/Insulator 45 and of the Positive Lead 44 and of the Positive Lead Retainer/Insulator Retaining Nubs 45B.
Figure 6B:
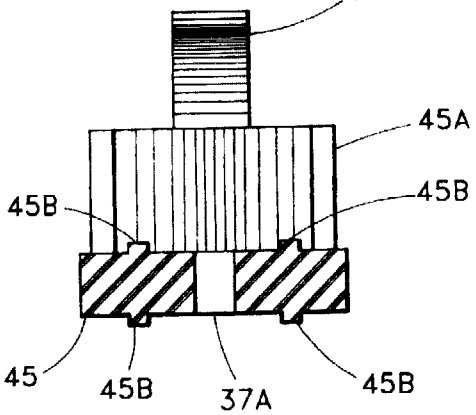
FIG. 6B is an elevation and section view of the Positive Lead retainer/insulator 45, the Positive Lead Retainer/Insulator Extension 45A and of the positive lead 44 taken though 6B—6B of FIG. 6.

Spring bias means and case means permits depression of Vehicle Accessory Power Take-Off/Cigarette Lighter 1 for heating of the Lighter Resistance Element 14 and provides for the physical connection to a receptacle means as follows:

Spring and Element Carrier Case Assembly 17, shown in FIGS. 1A, 2, and 7, is composed of three concentrically arranged assemblies including from inside to outside a Top Spring Retaining Cap 29, a Spring Retainer Case 23 and a Spring and Element Carrier Case 18. The Spring Retainer Case 23, shown in FIGS. 4, 4A, and the Spring and Element Carrier Case 18 are substantially cylindrical in shape.

1. The Spring and Element Carrier Case

Figure 8A:
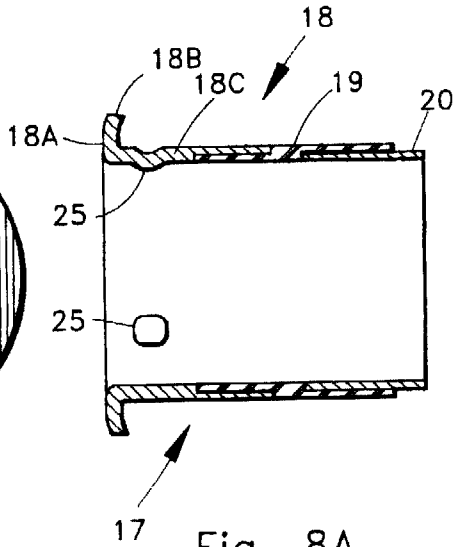
FIG. 8A is a section view of the spring and element carrier case Assembly 17 taken through 8A—8A of FIG. 8.

The Spring and Element Carrier Case 18, shown in FIGS. 1A, 2 and, being substantially cylindrical in shape has an inside and outside diameter and is formed with a Spring and Element Carrier Case First End 18A, which is open and a cylinder wall structure composed of an electrically conductive First Conductive Wall 18C proximal to the Spring and Element Carrier Case First End 18A, an electrically conductive Second Conductive Wall 20 distal to the Spring and Element Carrier Case First End 18A and an electrically insulating Spring and Element Carrier Case Insulator 19 intermediate and separating the respective First and Second Conductive Walls 18C, 20. The Spring and Element Carrier Case Insulator 19 is affixed by insulating heat resistant glue or other insulating, securing and heat resistant means to the First and Second Conductive Walls 18C, 20 such that the First Conductive Wall 18C is covered on the cylinder interior distal to the Spring and Element Carrier Case First End 18A and the Second Conductive Wall 19 is covered on the cylinder exterior proximal to the Spring and Element Carrier Case First End 18A. A section through the length of the essentially cylindrically shaped Spring and Element Carrier Case Insulator 19 is somewhat "z" shaped as shown in FIG. 8A. Three Spring and Element Carrier Case Retaining Dimples 25 are positioned intermediate the Spring and Element Carrier Case First End 18A and the Spring and Element Carrier Case Insulator 19 in the First Conductive Wall 18C spaced equidistant from each other and from the Spring and element Carrier Case First End 18A and intruding into the cylinder interior to provide a friction securing means between the Spring and Element Carrier Case 18 and the Spring Retainer Case 23.

The First Conductive Wall 18C proximal to the Spring and Element Carrier Case First End 18A is bent outward so as not to encroach into the cylindrical interior at the Spring and Element Carrier Case First End 18A forming a Spring and Element Carrier Case Lip 18B which in this embodiment forms essentially a 90 degree angle with the First Conductive Wall 18C.

2. Spring Retainer Case

The Spring Retainer Case 23, shown in FIGS. 1A, 2, 4 and 4A, being substantially cylindrical in shape has an inside and outside diameter and is formed with a Retainer Case First End 23D, which is open, a Retainer Case Wall 23F and a Retainer Case Bottom 23E which is partially capped or covered. The Retainer Case Wall 23F proximal to the Retainer Case First End 23D is bent outward so as not to encroach into the cylindrical interior at the Retainer Case First End 23D forming a Spring Retainer Case Lip 23A which in this embodiment forms essentially a 90 degree angle with the Retainer Case Wall 23F. The Retainer Case Bottom 23E has an dodecagonal(12 sided) shaped aperture centrally positioned therein forming a Element Carrier Aperture 23B which accepts the Element Carrier 9 and provides a securing means to prevent the axial rotation of the Element Carrier 9. When the upper body of Element Carrier 9 positioned within the Spring Retainer Case 23, the Element Carrier Shoulder 9G of the Element Carrier 9 is stopped and positioned by the Retainer Case Bottom 23E.

The Retainer Case Wall 23F having three Spring Retainer Case Retaining Slots 24 therein positioned intermediate the Retainer Case First End and the Retainer Case Bottom 23D, 23E and located and separated equidistant so as to receive the three Spring and Element Carrier Case Retaining Dimples 25 thereby allowing limited movement within and along the Longitudinal Axis 1A permitting the Element Head Assembly 13, when heated, to be safely recessed within the Spring and Element Carrier Case 18 when the Vehicle Accessory Power Take-Off Cigarette Lighter 1 is withdrawn from its receptacle 32 in order to light a cigarette and prohibiting rotation of the Spring and Element Carrier Case 18 when exchanging Element Head Assembly 13 and Faux Element Head Assembly 60 by appropriate utilization of the threaded means of Spring and Element Case 18, Element Head Assembly 13 and Faux Element Head Assembly 60. The Retainer Case Wall 23F having friction securing means with the Spring and Element Carrier Case 18 provided in this embodiment by three penetrations therein via Spring Retainer Case Friction Tongues 24A bent outward so as not to encroach into the Spring Retainer Case 23 cylindrical interior and so as to contact the Spring And Element Carrier Case 18 with the Spring Retainer Case Friction Tongues 24A located and separated equidistant so as not to intrude into the Spring Retaining Case Retainer Slots 24.

3. Top Spring Retaining Cap

The Top Spring Retaining Cap 29, shown in FIGS. 1A, 2 and, being substantially cylindrical in shape has an inside and outside diameter and is formed with a Top Spring Retaining Cap First End 29B, which is open, and a Top Spring Retaining Cap Wall 29C. The Top Spring Retaining Cap Wall 29C proximal to the Top Spring Retaining Cap First End 29B is bent inward to encroach on the cylinder interior forming a Top Spring Retaining Cap Lip 29A which in this embodiment forms essentially a 90 degree angle with the Top Spring Retaining Cap Wall 29C. The Top Spring Retaining Cap Lip 29A, being bent inward and encroaching on the cylinder interior forms a dodecagonal(12 sided) shaped aperture centrally positioned therein forming a Top Spring Element Carrier Aperture 29D which accepts the Element Carrier 9.

The Top Spring Retaining Cap 29 having an outside diameter less than the inside diameter of the Spring Retainer Case 23. The Top Spring Retaining Cap Lip 29A mechanically restrained by the Handle Second End 2B. A biasing means which in this embodiment is a Spring 26 having a Spring First and Second End 27, 28 and an inside and outside diameter. The Spring 26 inside diameter sufficient to receive the Element Carrier First End 9A. The Spring 26 is contained at the Spring First End 27 by the Handle Second End 2B and by the Top Spring Retaining Cap 29 and at the Spring Second End 28 by the Bottom Spring Retainer Lip 23C.

Assembly of the Spring and Element Carrier Case Assembly

The Spring and Element Carrier Case Assembly 17 components, shown in FIG. 7, are concentrically assembled in the order, from outside to inside, of the Spring and Element Carrier Case 18, the Spring Retainer Case 23 and the Top Spring Retaining Cap 29. The Top Spring Retaining Cap 29 bears with friction against the Spring Retainer Case 32 as the Assembly is moved from the open position of FIG.

1A to the closed or energized position with the Spring 26 being compressed when the assembly is in its closed position.

Receptacle Assembly for Vehicle Accessory Power Take-Off/Cigarette Lighter

Receptacle means for Vehicle Accessory Power Take-Off/Cigarette Lighter 1 and vehicle electrical biasing means are provided, by example herein as follows:

1. Vehicle Accessory Power Take-Off/Cigarette lighter Receptacle

The Vehicle Accessory Power Take-Off/Cigarette Lighter 1 resides, while functioning to provide power for the variety of devices to be operated within a vehicle, within a receptacle means, shown by example here and comprised in part of a Vehicle Accessory Power Take-Off/Cigarette Lighter Receptacle 32, shown in FIGS. 1A, 2, 3, 3A, 3B, 7, 8 and 8A, being substantially cylindrical in shape which has an inside and outside diameter and is formed with a Receptacle First End 32D, which is open, a Receptacle Bottom 32E which is capped or covered and a Receptacle Wall 32F. The Receptacle Wall 32F proximal to the Receptacle First End 32D is bent outward so as not to encroach into the cylindrical interior at the Receptacle First End 32D forming a Vehicle Accessory Power Take-off/Cigarette Lighter Receptacle Lip 23A which in this embodiment forms essentially a 90 degree angle with the Receptacle Wall 32F. The Receptacle Bottom 23E has an aperture centrally positioned therein forming a Element Head Clamping Spring and Grounding Device Screw Aperture 32B of a diameter as required to accept an Element Head Clamping Spring/Grounding Device Assembly Screw 37. Equidistant from the center of the Element Head Clamping Spring and Grounding Device Screw Aperture 32B and penetrating the Receptacle Bottom 32E are a plurality of Positive Lead Retainer/Insulator Retaining Nub Apertures 32C with two Positive Lead Retainer/Insulator Retaining Nub Apertures No. 1. 32C formed in this embodiment along a common diameter through the center of the Element Head Clamping Spring and Grounding Device Screw Aperture 32. The Receptacle Wall 32F, intermediate the Receptacle First End 32D and the Receptacle Bottom 32E, having a Positive Lead Aperture 33 therein. Upon rotation, when viewing from the Receptacle First End 32D, of the Vehicle Accessory Power Take-Off/Cigarette Lighter Receptacle 32 90 degrees clockwise in relation to the Positive Lead Aperture 33 a First Vehicle Accessory Power Take-Off/Cigarette Lighter Receptacle Friction Tongue and Element Head Clamping Spring/Grounding Device Aperture 34A therein intermediate the Receptacle First End 32D and the Receptacle Bottom 32E and upon rotation 90 degrees counter-clockwise in relation to the Positive Lead Aperture 33 a Second Vehicle Accessory Power Take-Off/Cigarette Lighter Receptacle Friction Tongue and Element Head Clamping Spring/Grounding Device Aperture 34B therein intermediate the Receptacle First End 32D and the Receptacle Bottom 32E and aligned with the First Vehicle Accessory Power Take-Off/Cigarette Lighter Receptacle Friction Tongue and Element Head Clamping Spring/Grounding Device Aperture 34A. Both the First Vehicle Accessory Power Take-Off/Cigarette Lighter Receptacle Friction Tongue and Element Head Clamping Spring/Grounding Device Aperture 34A and the Second Vehicle Accessory Power Take-Off/Cigarette Lighter Receptacle Friction Tongue and Element Head Clamping Spring/Grounding Device Aperture 34B having a Vehicle Accessory Power Take-Off/Cigarette Lighter Receptacle Friction Tongue 34 extending from the Receptacle Wall 32F proximal to the Receptacle First End 32D toward the Receptacle Bottom 32E into the respective apertures 34A, 34B and spring biased toward the cylinder interior of the Vehicle Accessory Power Take-Off/Cigarette Lighter Receptacle 32 to provide a friction securing means and good electrical continuity between the Vehicle Accessory Power Take-Off/Cigarette Lighter Receptacle 32 and the Spring and element Carrier Case 18.

Figure 9A:
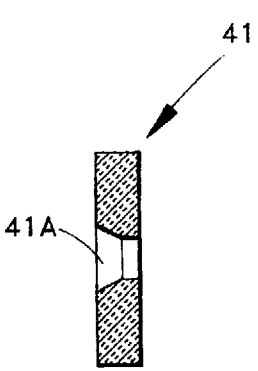
FIG. 9A is a section of the element head clamping spring and grounding device insulating washer 41 taken through 9A—9A of FIG. 9.
Figure 9:
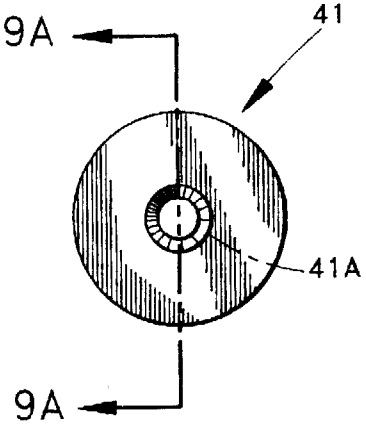
FIG. 9 is a top view of the element head clamping spring and grounding device insulating washer 41 which prevents the Lighter Resistance Element 14 from grounding to the base of the Element Head Clamping Spring and Grounding Device 39.
Figure 11A:
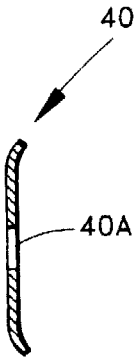
FIG. 11A is a section view of the element head clamping spring and grounding device seating washer 40 taken through 11A—11A of FIG. 11.
Figure 11:
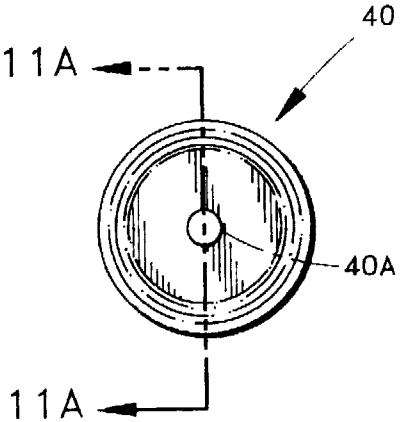
FIG. 11 is a top view of the element head clamping spring and grounding device seating washer 40.
Figure 10A:
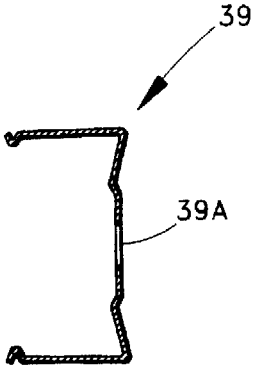
FIG. 10A is a section view of the element head clamping spring and grounding device 39 taken through 10A—10A of FIG. 10.
Figure 8:
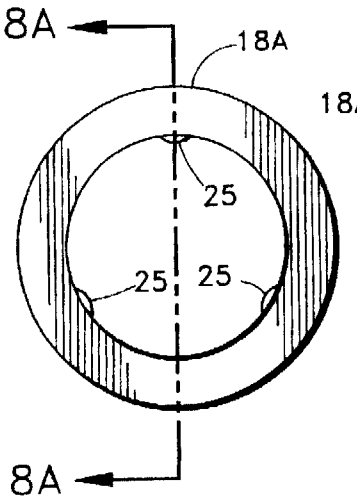
FIG. 8 is a top view of the spring and element carrier case Assembly 17.
Figure 10:
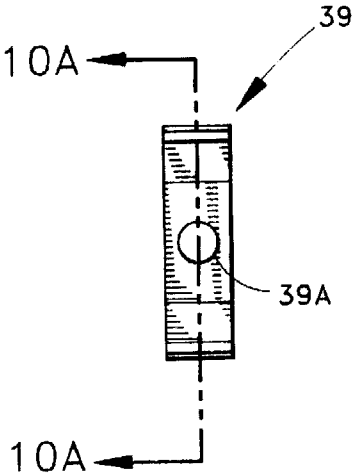
FIG. 10 is a top view of the element head clamping spring and grounding device 39.
Figure 12:
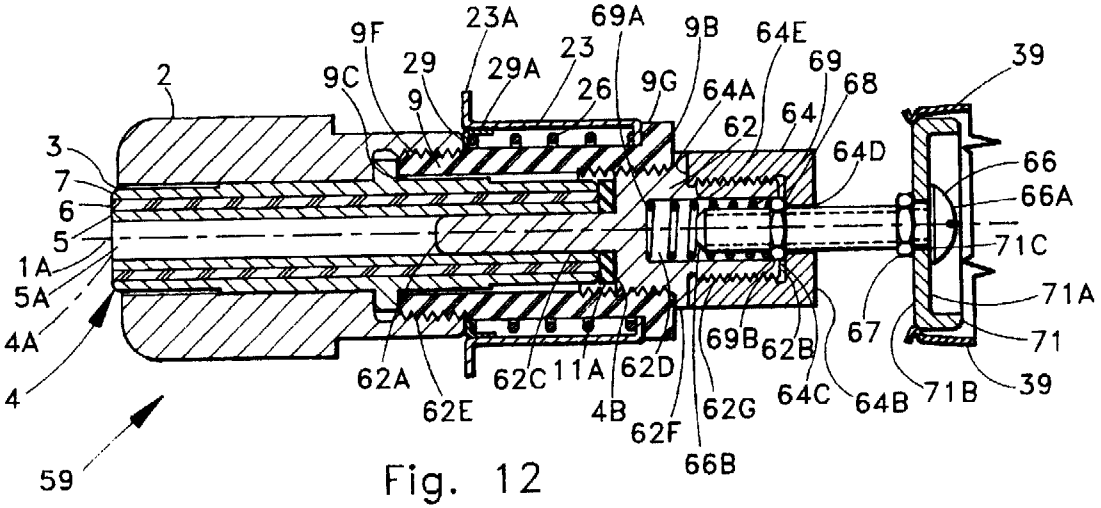
FIG. 12 is a section view of the Vehicle Accessory Power Take-Off/Faux Element Head 59, with Element Head Connector No. 2 and Faux Element Head Assembly 60 installed in place and stead of Element head connector No. 1 and Slip Ring 11 as shown in FIG. 1A and connected to a conventional cigarette lighter element head clamping spring and positive lead in place and stead of the element head clamping spring and grounding device of FIG. 1A, FIG. 2, FIG. 10 and FIG. 10A.

2. Subassembly Including Element Head Clamping Spring/Grounding Device and Positive Lead Retainer/Insulator Means at the Receptacle Bottom 32E to place the Lighter Resistance Element 14 into electrical ground potential provided in this embodiment by the assembly of an Element Head Clamping Spring/Grounding Device 39, shown at FIGS. 10 and 10A, formed as a clamp with spring bias which bias receives and engages the Element Head Case 13A; the Element Head Clamping Spring/Grounding Device 39 having an aperture therein as an Element Head Clamping Spring/Grounding Device Assembly Screw Aperture No. 2.39A. An electrical insulating washer Element Head Clamping Spring/Grounding Device Insulating Washer 41, shown at FIG. 9 and 9A, having an Element Head Clamping Spring/Grounding Device Assembly Screw Aperture No. 1. 41A. An Element Head Clamping Spring/Grounding Device Seating Washer 40, shown at FIG. 11 and 11A, having an Element Head Clamping Spring/Grounding Device Assembly Screw Aperture No. 3. 40A. An electrically insulating Positive Lead Retainer/Insulator 45, shown in FIG. 1, 2, 6, 6A and 6B, is substantially disk shaped having a First and Second Positive Lead Retainer Side 45C, 45D, a First Positive Lead Retainer Periphery 45E; the disk portion having an aperture centrally positioned therein from the First to the Second Positive Lead Retainer Side 45C, 45D as Element Head Clamping Spring/Grounding Device Assembly Screw Aperture No. 5. 37A. The disk shaped portion of the Positive Lead Retainer/Insulator 45 accepting the Receptacle Bottom 32E. A plurality of nubs being Positive Lead Retainer/Insulator Retaining Nubs 45B protrude on both sides of the disk shaped portion of the Positive Lead Retainer/Insulator 45 with this embodiment having two Positive Lead Retainer/Insulator Retaining Nubs 45B formed each on the First and Second Positive Lead Retainer Sides 45C, 45D and in this embodiment along a common diameter through the center of the Aperture 32. A Threaded Retainer For Vehicle Accessory Power Take-Off/Cigarette Lighter Receptacle Attachment and Ground Contact Case 48 being substantially cylindrical and having a First and Second Threaded Retainer End 48C, 48D with the First Threaded Retainer End 48C closed and the Second Threaded Retainer End open 48D. The First Threaded Retainer End 48C having an aperture therein centrally located as an Assembly Screw Aperture 48B. A plurality of apertures as Positive Lead Retainer/Insulator Retaining Nub Apertures No. 2. 48A with two Positive Lead Retainer/Insulator Retaining Nub Apertures 48A formed in this embodiment along a common diameter through the center of the Assembly Screw Aperture 48B.

The Vehicle Accessory Power Take-Off/Cigarette Lighter Receptacle 32 prepared to be secured in place by the alignment in order from within the cylinder of the Vehicle Accessory Power Take-Off/Cigarette Lighter Receptacle 32 of the apertures of 1.) the Element Head Clamping Spring/Grounding Device Assembly Screw Aperture No. 2. 39A; 2.) Element Head Clamping Spring/Grounding Device Assembly Screw Aperture No. 1.41A; 3.) Element Head Clamping Spring/Grounding Device Assembly Screw Aperture No. 3. 40A; 4.) Element Head Clamping Spring and Grounding Device Screw Aperture 32B; 5.) Element Head Clamping Spring/Grounding Device Assembly Screw Aperture No. 5. 37A and 6.) Assembly Screw Aperture 48B. The thread end of Element Head Clamping Spring/Grounding Device Assembly Screw 37 is received through the foregoing apertures commencing with Element Head Clamping Spring/Grounding Device Assembly Screw Aperture No. 2. 39A and upon passing in the above order through the six apertures concluding with Assembly Screw Aperture 48B is secured by means being an Element Head Clamping Spring/Grounding Device Assembly Nut 38. The alignment of these components dictated in part by the matching of the Positive Lead Retainer/Insulator Retaining Nubs 45B with the Positive Lead Retainer/Insulator Retaining Hub Apertures No. 1. 32C and the Positive Lead Retainer/Insulator Retaining Nub Apertures No. 2. 48A with said nubs and apertures positioned to be aligned as the Element Head Clamping Spring/Grounding Device Assembly Screw 37 is secured in place.

The Positive Lead Retainer/Insulator 45 having an extension from the First Positive Lead Retainer Side 45C at the First Positive Lead Retainer Periphery 45E as a Positive Lead Retainer/Insulator Extension 45A. The Positive Lead Retainer/Insulator 45 and Positive Lead Retainer/Insulator Extension 45A having an aperture therein from the Second Positive Lead Retainer Side 45D through the disk portion of the Positive Lead Retainer/Insulator 45 intermediate the First and Second Positive Lead Retainer Sides 45C, 45D and directed toward the First Positive Lead Retainer Periphery 45E and through the length of the Positive Lead Retainer/Insulator Extension 45A and concluding with penetration of the Positive Lead Retainer/Insulator Extension End 45F with the aperture being a Positive Lead Aperture 46. An electrically conductive Positive Lead 44, having a Positive Lead First and Second End 44A, 44B, enclosed by the Positive Lead Aperture 46 such that the Positive Lead First End 44A extends from said aperture at the Positive Lead Retainer/Insulator Extension End 45F and the Positive Lead Second End 44B extends from said aperture at the Second Positive Lead Retainer Side 45D. The Positive Lead First End 44A being spring biased, curved and sized to be received through the Positive Lead Aperture 33 of the Vehicle Accessory Power Take-Off/Cigarette Lighter Receptacle 32 and come into electrical contact with the Second Conductive Wall 20 of the Spring and Element Carrier Case 18 for the purpose of conveying positive electrical bias to the Element Head Connector No. 1 and Slip Ring 11. The First Threaded Retainer End 48C of the Threaded Retainer For Vehicle Accessory Power Take-Off/Cigarette Lighter Receptacle Attachment and Ground Contact Case 48 having an aperture therein as a First Threaded Retainer End Positive Lead Aperture 48E positioned in alignment with the Positive Lead Aperture 46 receiving the Positive Lead Second End 44B with said aperture dimensioned larger than the dimension of the Positive Lead Second End 44B so that the Positive Lead Second End 44B does not contact and is electrically isolated from the Threaded Retainer For Vehicle Accessory Power Take-Off/Cigarette Lighter Receptacle Attachment and Ground Contact Case 48. The Positive Lead Second End 44B being shaped to be accepted by a standard electrical connector.

3. Vehicle Accessory Power Take-Off/Cigarette Lighter Receptacle Attachment and Ground Contact Case The components which receive and secure in place, within a vehicle, the Vehicle Accessory Power Take-Off/Cigarette Lighter 1 are completed with a Vehicle Accessory Power Take-Off/Cigarette Lighter Receptacle Attachment and Ground Contact Case 50, shown in FIG. 1, 1A, 2, and 7, which is electrically conductive, is substantially cylindrical in shape, has an inside diameter and has First and Second Vehicle Accessory Ground Contact Case Ends 50B, 50C, a Vehicle Accessory Ground Contact Case Wall 50D and means affixed to or stamped into which permits electrical connection to the vehicle ground bias with the means provided in this embodiment by the Vehicle Accessory Ground Contact Case Wall 50D having a stamping therein producing a blade or tab as a Male Ground Connector 50A which protrudes outward, so as to not to encroach into the cylindrical interior, from the Vehicle Accessory Ground Contact Case Wall 50D and is shaped and dimensioned to be connected to a standard electrical connector. The First and Second Vehicle Accessory Ground Contact Case Ends 50B, 50C are open and the Vehicle Accessory Ground Contact Case Wall 50D proximal to the Second Vehicle Accessory Ground Contact Case End 50C has securing means which in this embodiment are threaded means.

The final assembly is made in a vehicle dashboard or other desired location denominated as bulkhead 8 having a bulkhead aperture 8A therein. The threaded retainer for Vehicle Accessory Power Take-Off/Cigarette Lighter Receptacle Attachment and Ground Contact Case 48, being substantially cylindrical in shape has an outside diameter which will be received by the inside diameter of the Vehicle Accessory Power Take-Off/Cigarette Lighter Receptacle Attachment and Ground Contact Case 50. Following assembly of components including Vehicle Accessory Power Take-Off/Cigarette Lighter Receptacle 32 through the Threaded Retainer For Vehicle Accessory Power Take-Off/Cigarette Lighter Receptacle Attachment and Ground Contact Case 48 via the Element Head Clamping Spring/Grounding Device Assembly Screw 37 by affixing the Element Head Clamping Spring/Grounding Device Assembly Nut 38, the Second Threaded Retainer End 48D is received through the bulkhead aperture 8A and by the First Vehicle Accessory Ground Contact Case End 50B with the threaded means proximal to the Second Threaded Retainer End 48D mating with the threaded means proximal to the Second Vehicle Accessory Ground Contact Case End 50C. The assembled components including the Vehicle Accessory Power Take-Off/Cigarette Lighter Receptacle 32, Positive Lead Retainer/Insulator and Threaded Retainer for Vehicle Accessory Power Take-Off/Cigarette Lighter Receptacle Attachment and Ground Contact Case 48 are dimensioned to be received by the inside diameter of the Vehicle Accessory Power Take-Off/Cigarette Lighter Receptacle Attachment and Ground Contact Case 50. The assembly is secured to the Bulkhead 8 by means including herein by the clamping action of the Vehicle Accessory Power Take-Off/Cigarette Lighter Receptacle Lip 32A and the First Vehicle Accessory Ground Contact Case End 50B on the Bulkhead 8 at the Bulkhead Aperture 8A.

SUMMARY

Figure 1C:
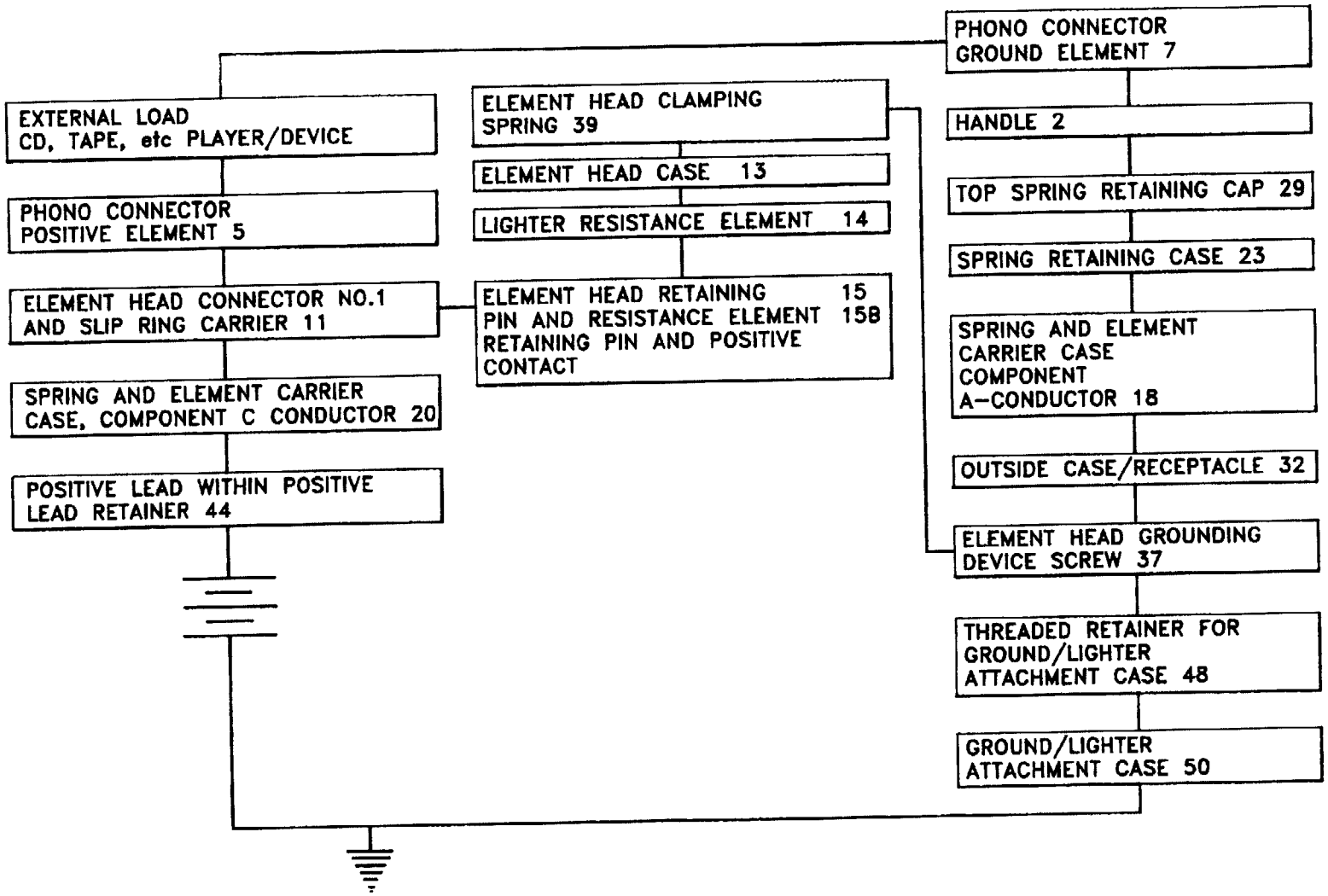
FIG. 1C is a block diagram schematic of the Vehicle Accessory Power Take-Off/Cigarette Lighter depicted in FIG. 1 and 1A.

The Vehicle Accessory Power Take-Off/Cigarette Lighter 1 and associated receptacle components electrically interrelate and operate as depicted in the flow chart of FIG. 1C.

II. VEHICLE ACCESSORY POWER TAKE-OFF/FAUX ELEMENT HEAD

An alternative form of electrical female connector means, received into a standard motor vehicle cigarette lighter receptacle is shown by example herein as follows:

Vehicle Accessory Power Take-Off/Faux Element Head 59 shown by FIGS. 12, 13, 13A and 13B is a form of the Vehicle Accessory Power Take-Off/Cigarette Lighter 1 without the cigarette lighter resistance element and related components; the function and component composition is the same in providing an electrical connection via a phono type jack at the handle with the component difference being the replacement of the Element Head Connector No. 1 and Slip Ring 11, Element Head Assembly 13 and Lighter Resistance Element 14 and components affixing these assemblies together. This unit is identical in components and function as the Vehicle Accessory Power Take-Off/Cigarette Lighter 1 with the exceptions as shown in the above indicated Figures and now as described. An Element Head Connector No. 2 62 being electrically conductive having a No. 2 First and Second End 62A, 62B and a No. 2 Surface 62C and being substantially circular in cross-section around an axis centrally located through the No. 2 First and Second Ends 62A, 62B. The Element Head Connector No. 2 62 having an outside diameter proximal to the No. 2 First End 62A so the No. 2 First End 62A is received into and is in electrical conductivity with the Phono Connector Positive Element Bore 5A.

The Element Head Connector No. 2 62 intermediate the No. 2 First and Second Ends 62A, 62B having an outside diameter and No. 2 Element Carrier Mating Means 62E including but not limited to friction, screw and threaded means such as to be received at the Element Carrier Second End 9B into the Element Carrier Aperture 9C and secured by Element Carrier Aperture Mating means 9F including but not limited to friction, screw and threaded means. An Element Head Connector Insulating Washer 11A or insulating means secured between the Phono connector Assembly Second End 4B and the Element Head Connector No. 2 62 when the Phono Connector Assembly 4, the Element Carrier 9 and Element Head Connector No. 2 62 are positioned and secured by the connected No. 2 Element Carrier Mating Means 62E and Element Carrier Aperture Mating means 9F. A No. 2 Shoulder 62F circumferentially positioned intermediate the No. 2 Element Carrier Mating Means 62E and No. 2 Second End 62B extending orthogonally to encounter the Element Carrier Second End 9B and thereby terminate the extent of receipt of No. 2 First End 62A into the Phono Connector Positive Element Bore 5A.

A Faux Element Head Spring and Adjusting Nut/Slide Ring Retaining Cap 64 being substantially cylindrical in shape having a First and Second Faux Element Head Spring Cap Ends 64A, 64B. The First Faux Element Head Spring Cap End 64A substantially open having a void therein as a First End Void 64C which provides securing means including but not limited to friction, screw and threaded means as First End Void Securing Means 64E. The Second Faux Element Head Spring Cap End 64B substantially closed having an aperture therein as a Second Faux Element Head Spring Cap End Aperture 64D.

A Faux Element Head 71 being substantially disk shaped having a First and Second Faux Element Head Surface 71A, 71B having an aperture therein as the Faux Element Head Aperture 71C centrally positioned within the disk shaped Faux Element Head 71 and extending from the First to the Second Faux Element Head Surface 71A, 71B. A screw as a Faux Element Head Retaining and Adjusting Screw 66 having a Screw Head 66A and Screw Thread End 66B. The Faux Element Head Retaining and Adjusting Screw 66 dimensioned to be received by the Screw Thread End 66B through the Faux Element Head Aperture 71C from the First to the Second Element Head Surface 71A, 71B and secured at the Second Element Head Surface 71B by securing means including nut means as a Faux Element Head Retaining Nut 67 so that the Screw Head 66A is in contact with the First Element Head Surface 71A; thereafter the Faux element Head Retaining and Adjusting Screw 66 received at the Second Faux Element Head Spring Cap End 64B by the Second Faux Element Head Spring Cap End Aperture 64D then protruding into the First End Void 64C. A nut secured to the Faux Element Head Retaining and Adjusting Screw 66 as a Faux Element Head Adjusting Nut/Slide Ring 68.

The surface of the No. 2 Second End 62B is substantially flat and has a No. 2 Second End Void 62D centrally located therein said void accepting a mechanical biasing means including a helical coil spring as a Faux Element Head Tensioning Spring 69 which has a Faux Element Spring First and Second End 69A, 69B.

The Element Head Connector No. 2 62 intermediate the No. 2 Shoulder 62F and Second End 62B having an outside diameter and No. 2 Faux Element Head Securing Means 62G proximal to the No. 2 Second End 62B including but not limited to friction, screw and threaded means such as to be received into the First End Void 64C and secured by the First End Void Securing Means 64E. When thus secured the Screw Thread End 66B of the Faux Element Head Retaining and Adjusting Screw 66 is received into the No. 2 Second End Void 62D and into the Faux Element Spring Second End 69B.

With the assembly completed the Longitudinal Axis 1A passes through the center of 1) No. 2 First and Second Ends 62A, 62B; 2) from the Faux Element Spring First to the Second End 69A, 69B; 3) from the Screw Thread End 66B to the Screw Head 66A with components thus concentrically related and assembled around the Longitudinal Axis 1A.

Figure 13B:
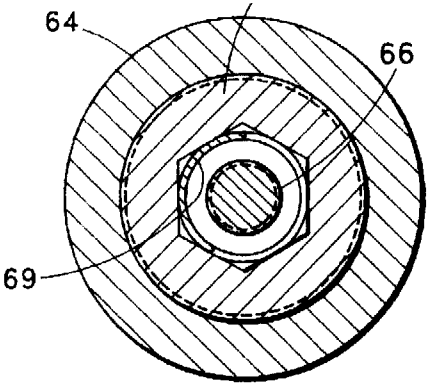
FIG. 13B is a section view of Element Head Connector No. 2 and Faux Element Head 60 taken through 13B—13B of FIG. 13.
Figure 13A:
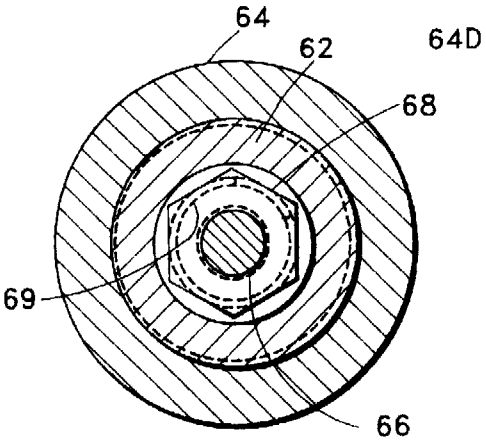
FIG. 13A is a section view of Element Head Connector No. 2 and Faux Element Head 60 taken through 13A—13A of FIG. 13.
Figure 13:
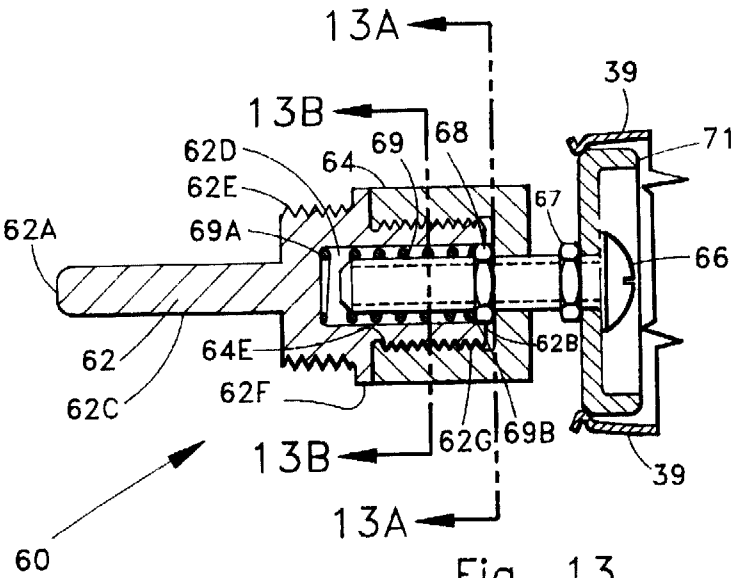
FIG. 13 is an enlarged section view of Element Head Connector No. 2 and Faux Element Head 60 as also shown in FIG. 12.
Figure 13C:
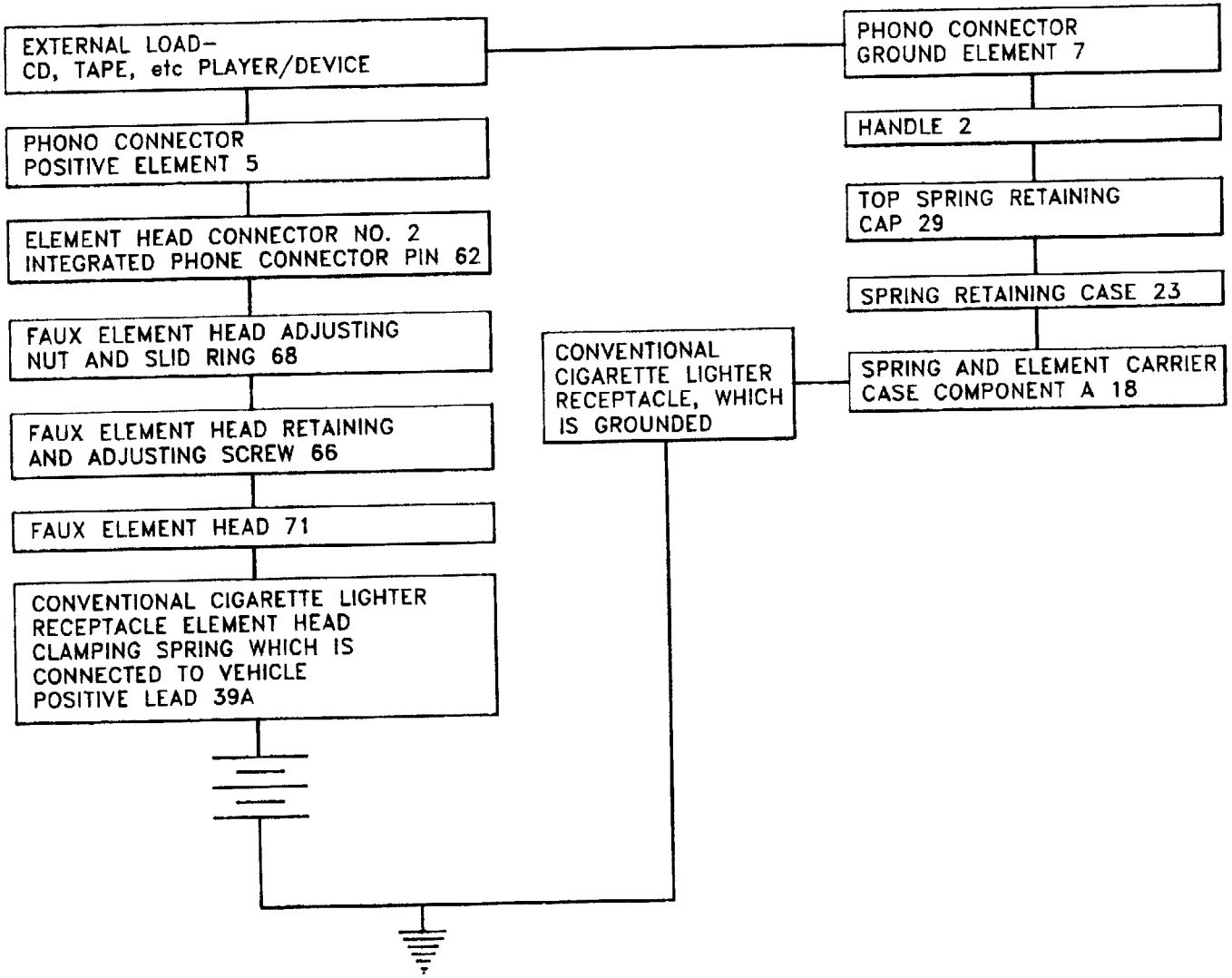
FIG. 13C is a block diagram schematic of the Vehicle Accessory Power Take-Off depicted in FIG. 12.
Figures 14, 14A:
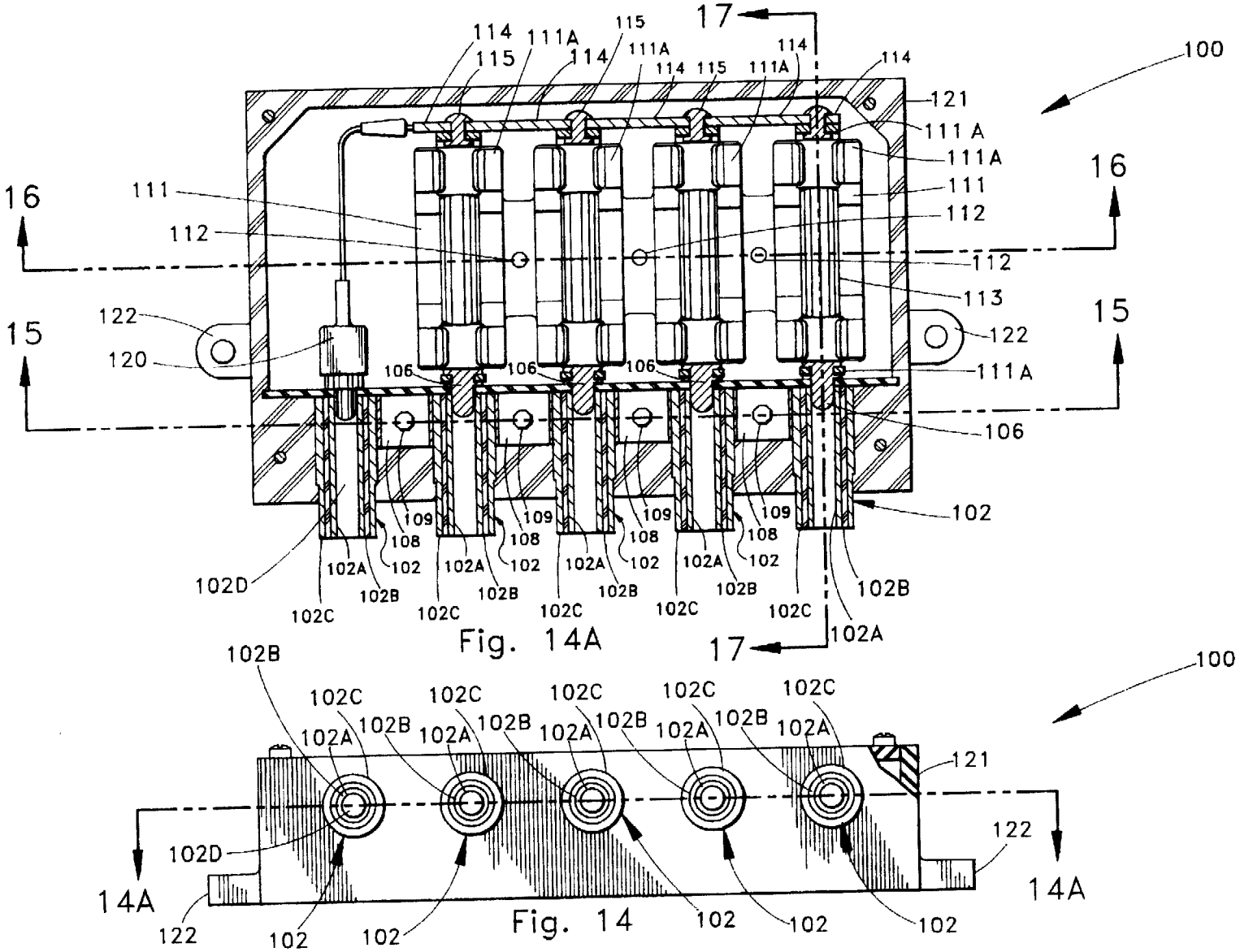
FIG. 14 is an elevation view of the front of the self-fused, multi-receptacle junction box.
FIG. 14A is a section view of the self-fused, multi-receptacle junction box taken through 14A—14A of FIG. 14.
Figure 17:
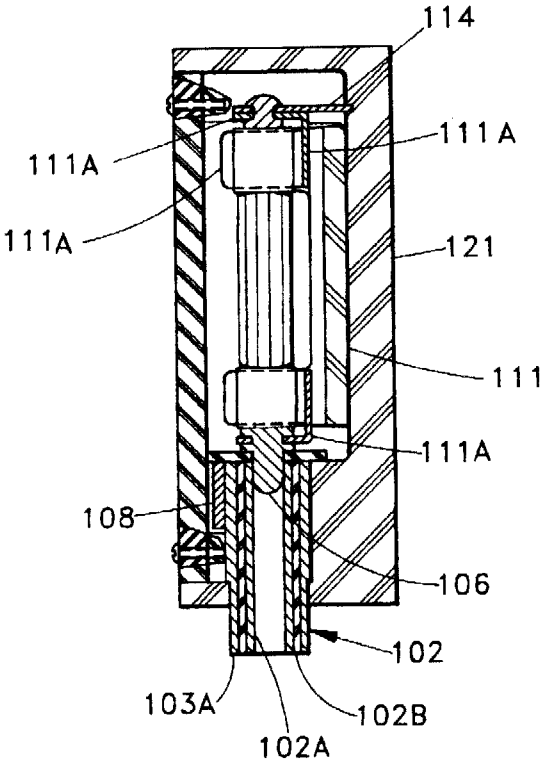
FIG. 17 is a section of the self-fused, multi-receptacle junction box taken through 17—17 of FIG. 14A.
Figure 15:
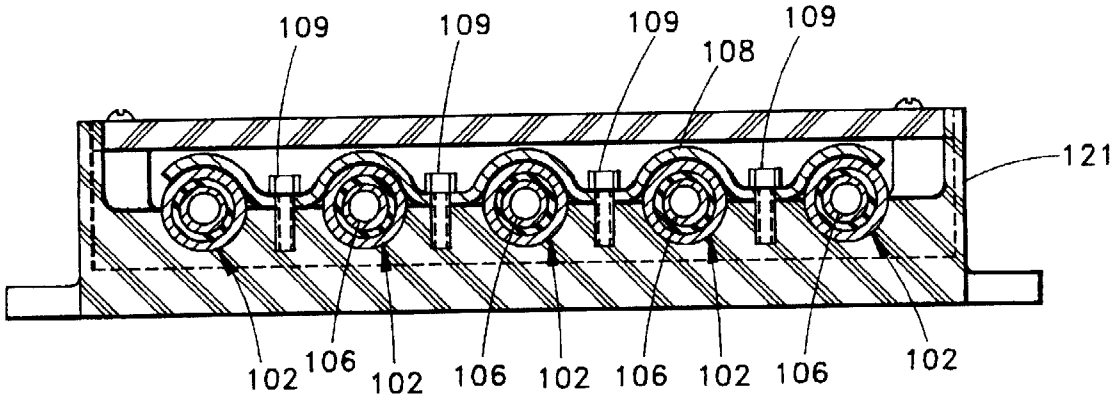
FIG. 15 is a section of the self-fused, multi-receptacle junction box taken through 15—15 of FIG. 14A.
Figure 16:
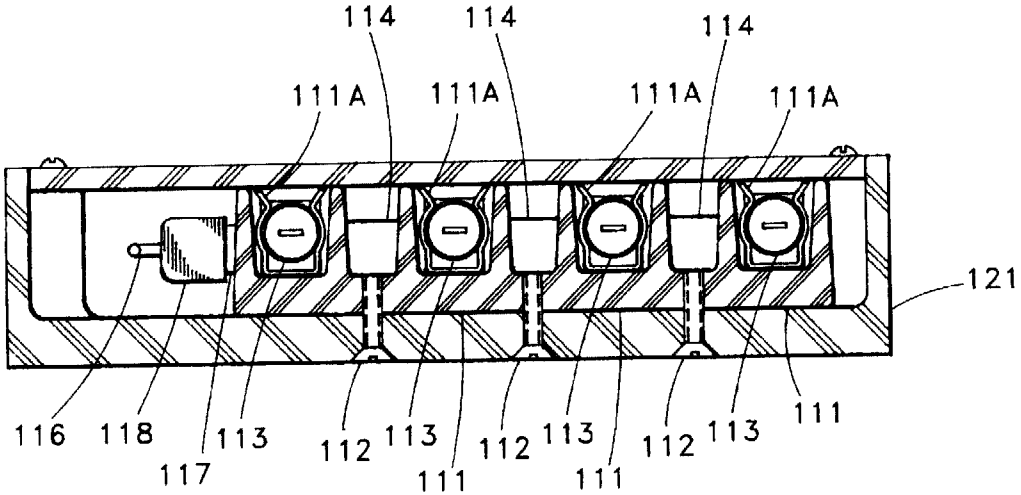
FIG. 16 is a section of the self-fused, multi-receptacle junction box taken through 16—16 of FIG. 14A.
Figure 18C:
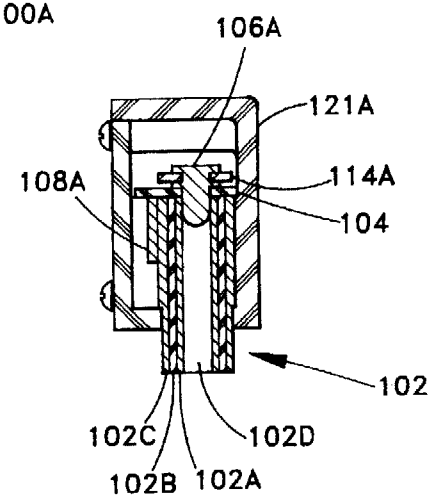
FIG. 18C is a section view of the original equipment multi-receptacle junction box taken through 18C—18C of FIG. 18A.
Figure 18A:
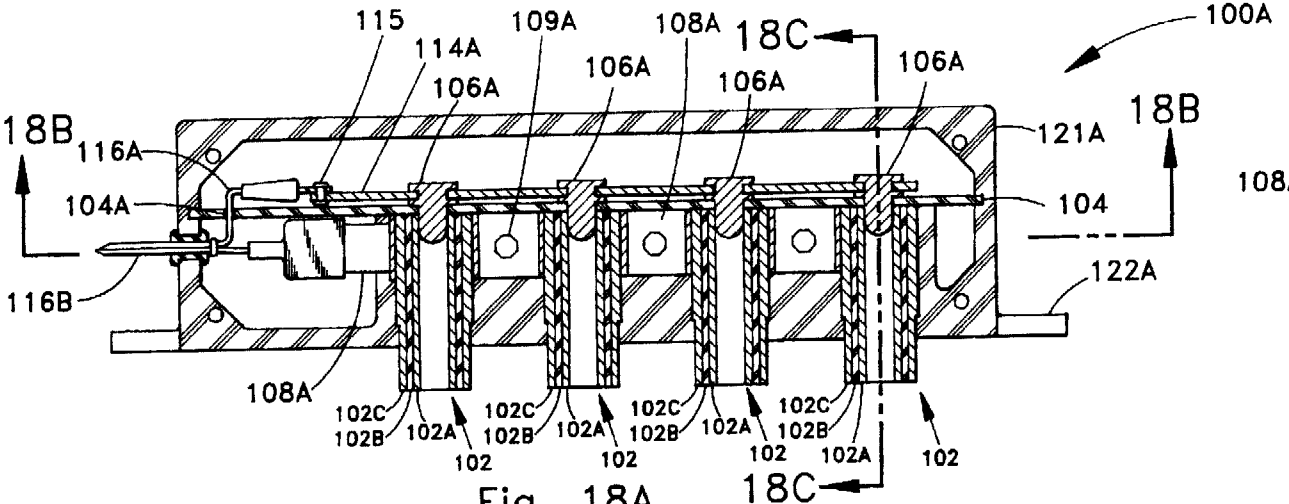
FIG. 18A is a section view of the original equipment multi-receptacle junction box taken through 18A—18A of FIG. 18.
Figure 18:
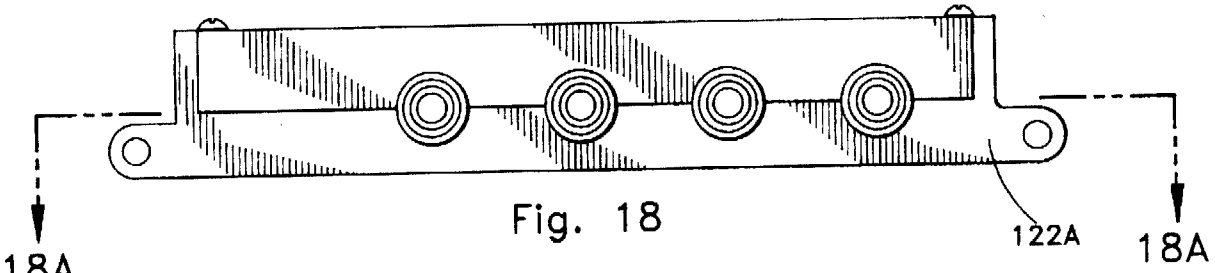
FIG. 18 is a front elevation view of the original equipment multi-receptacle junction box.
Figure 18B:
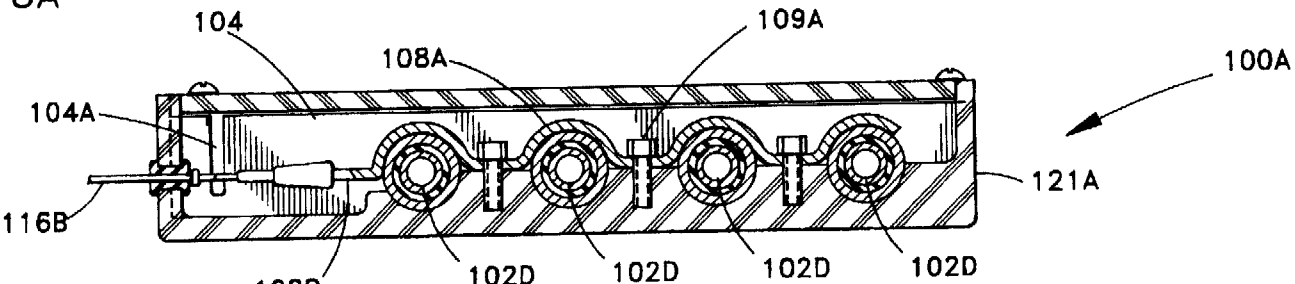
FIG. 18B is a section view of the original equipment multi-receptacle junction box taken through 18B—18B of FIG. 18A.

The Faux Element Head 71 being received and in electrical contact with the Element Head Clamping Spring/Grounding Device 39 of a standard cigarette lighter receptacle at all times the Vehicle Accessory Power Take-Off/Faux Element Head 59 is fully inserted within a standard cigarette lighter receptacle. Variances in depth among standard cigarette lighter receptacles is accommodated by adjusting the Faux Element Head 71 to the appropriate depth by rotating the Faux Element Head 71 and its attached Retaining and Adjusting Screw 66 counterclockwise or clockwise, as the case requires, against the threaded means of the rotationally inhibited Faux Element Head Adjusting Nut/Slide Ring 68 until the appropriate adjustment is obtained. The operation of the system using the Faux Element Head 71 is demonstrated in flow chart form at FIG. 13C.

III. QUICK CONNECT PHONO TYPE PLUG

Male electrical connector means for the Vehicle Accessory Power Take-Off System is provided by a Quick Connect Phono Type Plug 74, of this disclosure, shown in FIGS. 19, 19A, 20, 20A, 21, 21A, 21B, 22, 23, 23A, 24 and 24A, is composed of a Plug Cap 75 being substantially cylindrical in shape having a First and Second Plug Cap End 75A, 75B. The First Plug Cap End 75A substantially open having a void therein as a First Plug Cap End Void 75C which provides, proximal to the First Plug Cap End 75A securing means including but not limited to friction, screw and threaded means as First Plug Cap End Void Securing Means 75E. A bore forming a Spring Housing 75F intermediate the First Plug Cap End Void 75C and the Second Plug Cap End 75B with both the Spring Housing 75F and the First Plug Cap End Void 75C substantially circular in cross-section around an axis centrally located from the First to the Second Plug Cap End 75A, 75B. The inside diameter of the Spring Housing 75F less than the inside diameter of the First Plug Cap End Void 75C. The Second Plug Cap End 75B substantially closed having an aperture therein as a Second Plug Cap End Aperture 75D extending from the Second Plug Cap End 75B into the Spring Housing 75F.

An insulating mechanical biasing means including herein a helical coil spring as a Clamping Plate Non-Conductive Tension Spring 79 having a First and Second Clamping Plate Spring End 79A, 79B with the Clamping Plate Non-Conductive Tension Spring 79 having an outside diameter such that the Second Clamping Plate Spring End 79B is received into the Spring Housing 75F.

Insulating means including in this embodiment a substantially disk shaped electrically insulating Clamping Plate 78 having First and Second Clamping Plate Sides 78B, 78C and two apertures therein from the Second to the First Clamping Plate Sides 78C, 78B consisting of Positive and Ground Clamping Plate Apertures 78D, 78E with said apertures substantially equidistant along a common diameter from the center of the Second Clamping Plate Side 78C. The First Clamping Plate Side 78B having a notch therein across the entire diameter as a Nipple Notch 91A being oriented orthogonally to the diameter locating the Positive and Ground Clamping Plate Apertures 78D, 78E. The First Clamping Plate Side 78B having a pair of indentations parallel with the Nipple Notch 91A with one extending from the Positive Clamping Plate Apertures 78D as a Clamping Plate Positive Lead Indentation 82A and one extending from the Ground Clamping Plate Aperture 78E as a Clamping Plate Ground Lead Indentation with both dimensioned sufficient to accommodate AWG 12 electrical wiring.

A two conductor power cord received into the Second Plug Cap End Aperture 75D at the Second Plug Cap End 75B, into the Spring Housing 75F and into the Second Clamp Plate Spring End 79B and through the First Clamp Plate Spring End 79A with a Power Cord Positive Lead 82 received through the Positive Clamping Plate Aperture 78D and lodged in the Clamping Plate Positive Lead Indentation 82A and the Power Cord Ground Lead 83 received through the Ground Clamping Plate Aperture 78E and lodged in the Clamping Plate Ground Lead Indentation 78A.

A Plug Body 85 being electrically insulating having a First and Second Plug Body End 85A, 85B and a Plug Body Surface 85C and being substantially circular in cross-section around an axis centrally located through the First and Second Plug Body Ends 85A, 85B. The Plug Body 85 having an outside diameter proximal to the Second Plug Body End 85B and Second Plug Body End Mating Means 85D including but not limited to friction, screw and threaded means such as to be received into the First Plug Cap End 75A and secured and mated with the First Plug Cap End Void Securing Means 75E. Means to orient the Second Plug Body End 85B in relation to the Clamping Plate 78 when the Plug Cap 85 is accepted into and secured in the First Plug Cap End 75A including, as shown in FIGS. 19A, 21, 21A and 21B, a plurality of nipples, found here as a Nipple Extension of Plug Body 91 at the Second Plug Body End 85B dimensioned to be received by a Nipple Notch 91A positioned in the First Clamping Plate Side 78B.

Figure 19A:
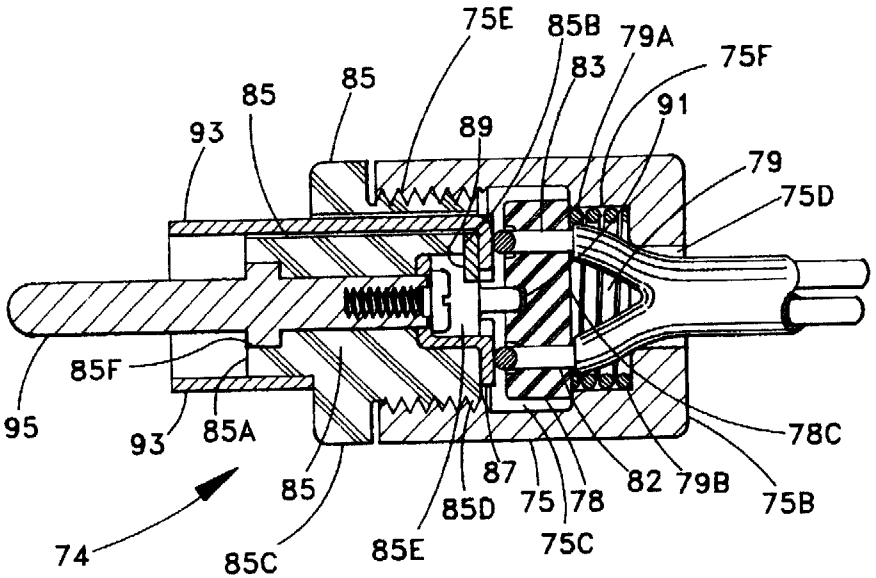
FIG. 19A is section view of the quick-connect phono-type connector plug taken through 19A—19A of FIG. 19.
Figure 20:
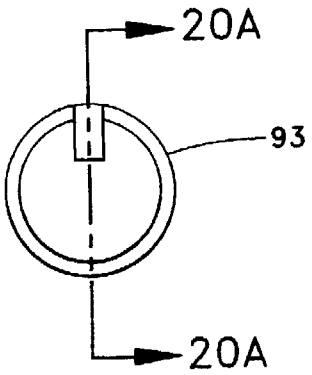
FIG. 20 is a top view of the phono connector female ground clip and its extension.
Figure 20A:
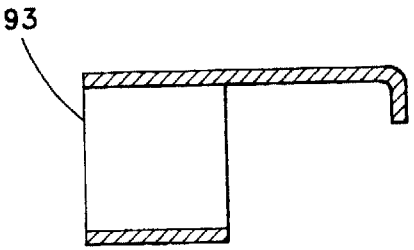
FIG. 20A is a section view of the phono connector female ground clip and its extension taken through 20a—20a of FIG. 20.
Figure 19:
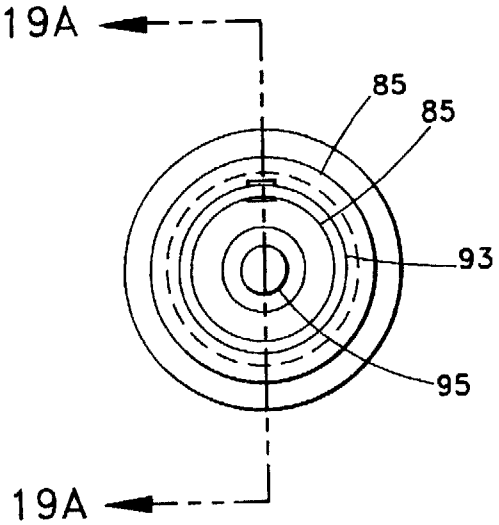
FIG. 19 is a top view of the quick-connect phono-type connector plug.

The Plug Body 85 having a void therein, as shown in FIG. 19A, found here as a Plug Body Void 85E extending from the First to the Second Plug Body End 85A, 85B and symmetrically positioned about an axis centrally located through the First and Second Plug Body Ends 85A, 85B. Electrical contact means separately for positive and ground, at the Second Plug Body End 85B, to match with the Power Cord Positive Lead 82 and the Power Cord Ground Lead 83 when the Plug Body 85 is mated with the Plug Cap 75; the means herein shown in FIGS. 19, 19A, 20, 20A, 21, 21A, 21B, 22, 23, 23A, 24 and 24A including, at the Second Plug Body End 85B, a pair of electrically conductive contacts positioned to be in contact respectively with the Power Cord Positive and Ground Leads 82, 83 at the Clamping Plate Positive and Ground Lead Indentations 82A, 78A and provided here for positive and ground bias respectively by Positive and Ground Contact Plates 87, 89. The Positive and Ground Contact Plates 87, 89 separated by the electrically insulating Nipple Extension of Plug body 91.

The Positive Contact Plate 87 being in electrical continuity with a pin, shown in FIG. 19A as a Phono Connector Positive Pin 95, which is appropriately dimensioned to be received, as a part of an electrical connector, by the Vehicle Accessory Power Take-Off/Cigarette Lighter 1 at the Phono Connector Assembly First End 4A and into the Phono Connector positive Element Bore 5A. The electrical continuity between the Positive Contact Plate 87 and the Phono Connector Positive Pin 95 is by means and as shown in FIG. 19A to include the Positive Contact Plate 87 being shaped to be inserted into the Plug Body Void 85E proximal to the Second Plug Body End 85B and therein to be mechanically secured with a screw to the Phono Connector Positive Pin 95. The Phono Connector Positive Pin 95 is, in this embodiment and as shown in FIG. 19A received into the Plug Body Void 85E from the First Plug Body End 85A having mating means, here as threads, and shoulder or stopping means to fix the extent to which insertion is permitted within the Plug Body Void 85E.

The Ground Contact Plate 89 is in electrical continuity by means with a barrel shaped conductor, substantially cylindrical in shape, concentrically positioned with the Phono Connector Positive Pin 95 and extending from the First Plug Body End 85A; the barrel shaped conductor herein shown in FIG. 19A and provided as a Phono Connector Female Ground Clip 93 which is dimensioned and shaped to be received by the Vehicle Accessory Power Take-Off/Cigarette Lighter i by the Phono-Plug Female Clip Aperture 3 to be in continuity with the Vehicle electrical ground. The Phono Connector Female Ground Clip 93 combines with the Phono Connector Positive Pin 95 in dimension and shape to function as an electrical connector in mating with the Vehicle Accessory Power Take-Off/Cigarette Lighter 1.

IV. AFTER MARKET MULTI-RECEPTACLE JUNCTION BOX

The After Market Multi-Receptacle Junction Box 100 of this disclosure, shown in FIGS. 14, 14A, 15, 16 and 17, provides a plurality of electrical female connector means for the purpose of mating with and providing electrical power to appliances to be operated within or from a vehicle. Such means may be as shown herein by FIGS. 14, 14A, 15, 16 and 17 where a connection to vehicle ground potential is insulated from a connection to vehicle positive potential in the form of a plurality of female electrical Phono Plug Connectors 102 which mechanically and electrically receive and mate with the Quick Connect Phono Type Plug 74 where electrical bias is delivered by the plurality of Phono Plug Connectors 102 as by the Vehicle Accessory Power Take-Off/Cigarette Lighter 1 with the Vehicle ground potential found at a Phono Plug Connector Ground Element 102C and the positive potential provided by a Phono Plug Connector Positive Element 102A with the Phono Plug Connector Ground Element 102C and the Phono Plug Connector Positive Element 102A electrically isolated by a Phono Plug Connector Insulator 102B and the female access means provided by a Phono Plug Pin Aperture 102D.

The Plurality of electrical connector means shown herein as Phono Plug Connectors 102 are positioned or mounted within the vehicle by means including as shown herein at FIGS. 14, 14A, 15, 16 and 17, container means including a Plastic Case After Market Junction Box Type 121. Electrical continuity of vehicle ground and positive potential is provided to the plurality of electrical connectors by means, including as shown herein by one or a plurality of said electrical connectors receiving electrical potential from the vehicle electrical power supply via a male electrical connector means (such as a jumper cable) with a Quick Connect Phono Type Plug 74, on each end, with the means including a buss for vehicle ground including that as shown herein as a Phono Plug Connector Clamp and Ground 108. Means including buss and fusing means is provided for vehicle positive potential including that as shown herein composed of a connector as a Female Electrical Connector No. 2 120 in electrical continuity with a Positive Conductor Strip After Market Junction Box Type 114. A plurality of electrical fuse means, shown herein as Fuse 113 are secured, within the container means, by fuse mounting means shown here as Fuse Holder Base 111, Fuse Holder Fuse Clamping/Electrical Contact Assembly 111A and a Fuse Holder Retaining Screw 112. Each of the plurality of fuse means provide further electrical continuity with a respective electrical connector, shown herein as the Phono Plug Connector 102 supplying positive electrical bias to the Phono Plug connector Positive Element 102A via a pin or other electrical connector shown here as a Male Phono Plug Connector Pin 106 which is received into the Phono Plug Pin Aperture 102D.

The container means is affixed or mounted by means to the Vehicle, likely within the vehicle driver/passenger compartment, with said means including brackets, for example as shown herein by a Plastic Case Mounting Bracket 122, and screws or other mounting or securing means.

V. ORIGINAL EQUIPMENT MULTI-RECEPTACLE JUNCTION BOX

The Original Equipment Multi-Receptacle Junction Box 100A of this disclosure, shown in FIGS. 18, 18A, 18B and 18C, provides a plurality of electrical female connector means for the purpose of mating with and providing electrical power to appliances to be operated within or from a vehicle. Such electrical connector means may be as shown herein by FIGS. 18, 18A, 18B and 18C where a connection to vehicle ground potential is insulated from a connection to vehicle positive potential in the form of a plurality of female electrical Phono Plug Connectors 102 which mechanically and electrically receive and mate with a Quick Connect Phono Type Plug 74 where electrical bias is delivered by the plurality of Phono Plug Connectors 102 as by the Vehicle Accessory Power Take-Off/Cigarette Lighter i with the Vehicle ground potential found at a Phono Plug Connector Ground Element 102C and the positive potential provided by a Phono Plug Connector Positive Element 102A with the Phono Plug Connector Ground Element 102C and the Phono Plug Connector Positive Element 102A electrically isolated by a Phono Plug Connector Insulator 102B and the female access means provided by a Phono Plug Pin Aperture 102D.

The plurality of electrical female connector means shown herein as Phono Plug Connectors 102 are positioned or mounted within the vehicle by means including, as shown herein at FIGS. 18, 18A, 18B and 18C, container means including a Plastic Case Original Equipment Junction Box Type 121A. Electrical continuity of vehicle ground and positive potential is provided to the plurality of electrical female connectors by direct connection from the vehicle ground and positive potential system to a ground and a positive buss means including as shown herein in FIG. 18A direct wiring to the positive potential via a Positive Lead Original Equipment Junction Box Type 116A and to the ground potential via a Ground Lead Original Equipment Junction Box Type 116B connecting respectively to buss means including as shown here a Positive Conductor Strip Original Equipment Junction Box Type 114A and Phono Plug Connector Clamp and Ground Original Equipment Junction Box Type 108A. A plurality of pin or connector means provide further electrical continuity with a respective electrical connector, shown herein as the Phono Plug Connector 102 supplying positive electrical bias to the Phono Plug connector Positive Element 102A via a pin or other electrical connector shown here as a Male Phono Plug Connector Pin Installed in Original Equipment 106A which is received in to the Phono Plug Pin Aperture 102D.

The container means is affixed or mounted by means to the Vehicle, likely within the vehicle driver/passenger compartment including the vehicle dashboard, with said means including brackets, as shown for example herein by a Plastic Case Mounting Bracket Original Equipment 122A, and screws or other mounting or securing means.

VI. SUMMARY OF VEHICLE ACCESSORY POWER TAKE-OFF SYSTEM

Figure 25:
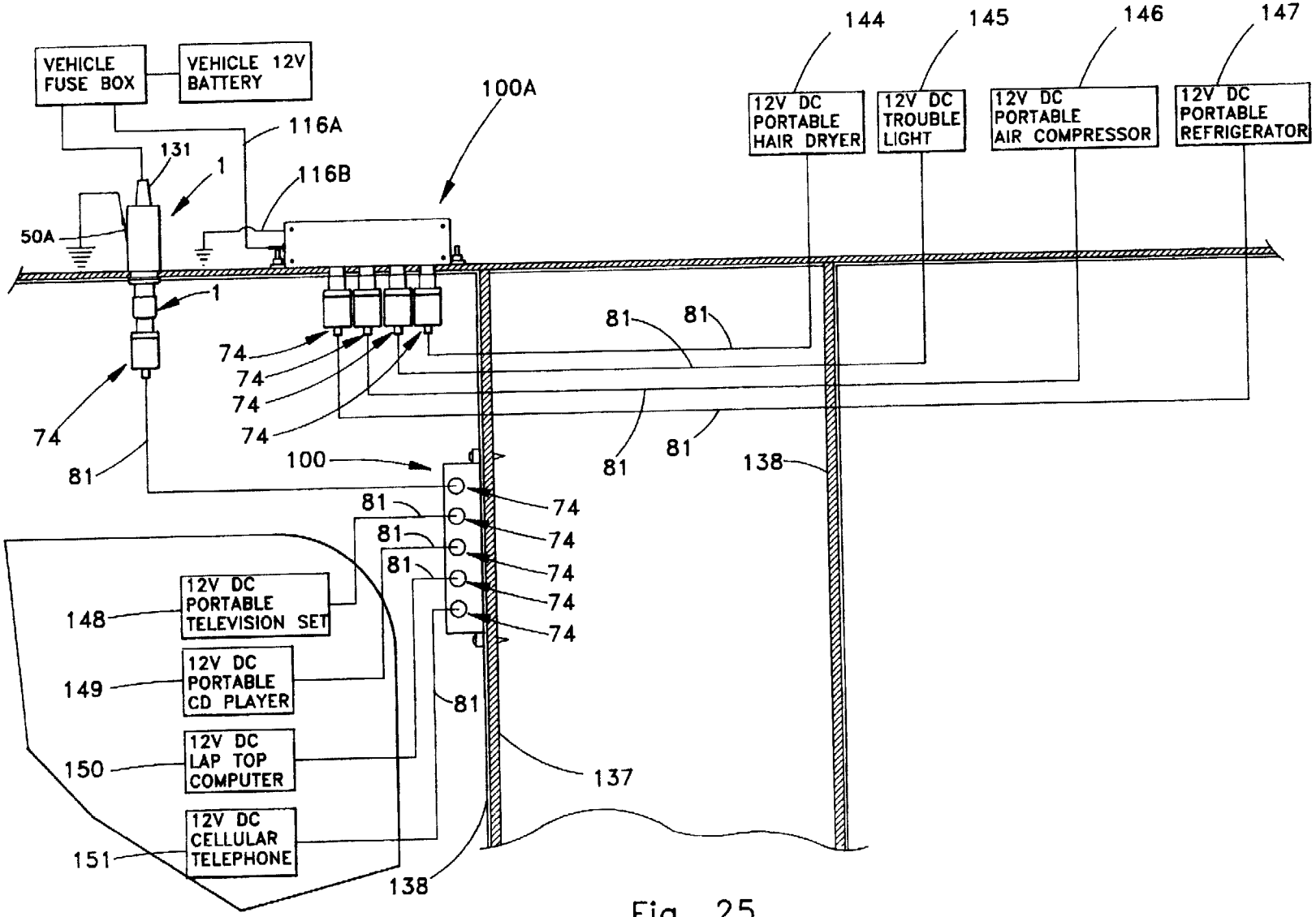
FIG. 25 illustrates the invention in place in an automotive vehicle.

The Vehicle Accessory Power Take-Off System of this disclosure is summarized graphically by FIG. 25. FIG. 25 depicts electrical connector means shown here as a Vehicle Accessory Power Take-Off/Cigarette Lighter 1 mounted in a vehicle dashboard or Bulkhead 8 receiving vehicle ground potential via means with the source shown herein as the Male Ground Connector 50A and vehicle positive potential via means including herein a Female Electrical Connector for Positive Lead 131 connecting to the Positive Lead 44 shown in FIG. 1A. This electrical connector means, shown as the Vehicle Accessory Power Take-Off/Cigarette Lighter 1, receives electrical connector means shown here as a Quick Connect Phono Type Plug 74 which in turn either directly connects to an accessory or provides power, via an electrical jumper, to a plurality of electrical connectors shown here as contained in an After Market Multi-Receptacle Junction Box 100 providing a plurality of female electrical connector means, shown in FIGS. 18, 18A, 18B and 18C as Phono Plug Connectors 102. A plurality of electrical connector means, shown in FIG. 25 as Quick Connect Phono Type Plugs 74, convey electrical power from the plurality of electrical connectors provided by the After Market Multi-Receptacle Junction Box 100 to a variety of accessories including Portable Televisions Sets 148, Portable CD Players 149, Lap Top Computers 150, Cellular Telephones 151 and other appliances.

Separately depicted in FIG. 25 as original vehicle equipment is container means providing a plurality of electrical connector means shown here as an Original Equipment Multi-Receptacle Junction Box 100A with a plurality of Phono Plug Connectors 102 with said container means mounted to the vehicle dashboard, Bulkhead 8 or at other locations within a vehicle. Ground buss means, shown in FIG. 18A as Ground Lead Original Equipment Junction Box Type 116B, and positive vehicle buss means, shown in FIG. 18A and 25 as Positive Lead Original Equipment Junction Box Type 116A, are connected respectively to the vehicle ground and positive electrical potentials and provide ground and positive potentials respectively to the plurality of said electrical connectors. Separate electrical connector means, shown here as Quick Connect Phono Type Plugs 74, are received by the electrical connectors mounted to the vehicle Bulkhead 8 and in turn convey electrical power to a variety of accessories including Portable Hair Dryers 144, Trouble Lights 145, Portable Air Compressors 146, Portable Refrigerators 147 and other accessories.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A Vehicle Accessory Power Take-Off System Including Phono/RCA Type Plug And Jack For Use With Cigarette Lighter Plug/Jack comprising an apparatus for improvement in interfacing low amperage electrically powered portable work and entertainment devices, including, but not limited to, 6 or 12 volt direct current devices, used in and about automotive vehicles and the improvement being further directed to the elimination, replacement or substitution of the presently existing standard cigarette lighter receptacle and its companion plug and thus the elimination of the size-linked encumbrance of existing cigarette lighter electrical connections and further comprising:

A. a plurality of electrical receptacles and

B. an electrical connector to be received by the electrical receptacles with the electrical connector of a size which is more convenient than a connector accommodated by a motor vehicle standard cigarette lighter receptacle and which is of such structural integrity as to resist deterioration or breaking of wiring;

C. the plurality of electrical receptacles per vehicle is facilitated by reducing the size of the electrical connector and receptacle interface through the employment of phono-type plug and jack electrical connectors in replacement of the present standard automotive vehicle cigarette lighter/electrical connectors;

D. the phono-type plug and jack electrical connectors are RCA plugs and jacks;

E. a vehicle accessory power take-off/cigarette lighter 1 is received into a vehicle accessory power take-off/cigarette lighter receptacle 32 in mechanical and electrical continuity with a vehicle accessory power take-off/cigarette lighter receptacle attachment and ground contact case 50; said vehicle accessory power take-off/cigarette lighter receptacle attachment and ground contact case 50 is secured in a vehicle dashboard;

F. a vehicle accessory power take-off/faux element head 59 is received into and in mechanical and electrical continuity with a standard automotive cigarette lighter receptacle; said standard automotive cigarette lighter receptacle secured in a vehicle dashboard;

G. a quick connect phono type plug 74; receptacle means in the vehicle accessory power take-off/cigarette lighter 1 to receive in mechanical and electrical continuity the quick connect phono type plug 74;

H. an after market multi-receptacle junction box 100 having a plurality of phono plug connectors 102; the phono plug connectors 102 providing receptacle means to receive in mechanical and electrical continuity the quick connect phono type plug 74;

I. quick connect phono type plugs 74 adapted to provide electrical power to portable work and entertainment devices such as portable televisions, cellular telephones, computers and other such devices for use in and about automotive vehicles; said quick connect phono type plugs 74 to be received by means including phono plug connectors 102.

2. A Vehicle Accessory Power Take-Off System Including Phono/RCA Type Plug And Jack For Use With Cigarette Lighter Plug/Jack comprising:

A. a combination phono-jack type power take-off and cigarette lighter with a receptacle of special design providing for the continued presence of a functioning vehicle cigarette lighter combined with a power take-off feature to provide electrical power to a variety of electrically powered devices used in and about automotive vehicles;

B. a vehicle accessory power take-off/faux element head 59 received into and maintained in mechanical and electrical continuity with a standard vehicle cigarette lighter receptacle with means to provide electrical power to a variety of electrically powered devices used in and about automotive vehicles;

C. a quick-connect phono-type plug 74 which is electrically and mechanically received by the combination phono-jack type power take-off and cigarette lighter or the vehicle accessory power take-off/faux element head 59; the quick-connect phono-type plug 74 is adapted to the power cord of portable electrical or electronic devices by the consumer or original manufacturer in replacement of or as an alternative to the presently used cigarette lighter-type electrical connector for electrically powered devices used in and about an automotive vehicle;

D. a self-fused, multi-receptacle junction box, which can be mounted as an after-market installation within an automotive vehicle, providing a plurality of phono plug connectors 102 receiving the quick-connect phono-type plug 74; said multi-receptacle junction box connected to the vehicle's power supply via an extension cord connection to the combination phono-jack type power take-off and cigarette lighter or connected directly to the electrical system of the vehicle.

3. A Vehicle Accessory Power Take-Off System Including Phono/RCA Type Plug And Jack For Use With Cigarette Lighter Plug/Jack comprising an apparatus for improvement in interfacing low amperage electrically powered portable work and entertainment devices, including, but not limited to, 6 or 12 volt direct current devices, used in and about automotive vehicles and the improvement being further directed to the elimination, replacement or substitution of the presently existing standard cigarette lighter receptacle and its companion plug and thus the elimination of the size-linked encumbrance of existing cigarette lighter electrical connections and further comprising:

A. a plurality of electrical receptacles and

B. an electrical connector to be received by the electrical receptacles with the electrical connector of a size which is more convenient than a connector accommodated by a motor vehicle standard cigarette lighter receptacle and which is of such structural integrity as to resist deterioration or breaking of wiring;

C. the plurality of electrical receptacles per vehicle is facilitated by reducing the size of the electrical connector and receptacle interface through the employment of phono-type plug and jack electrical connectors in replacement of the present standard automotive vehicle cigarette lighter/electrical connectors;

D. the phono-type plug and jack electrical connectors are RCA plugs and jacks;

E. a vehicle accessory power take-off/cigarette lighter 1 is received into a vehicle accessory power take-off/cigarette lighter receptacle 32 in mechanical and electrical continuity with a vehicle accessory power take-off/cigarette lighter receptacle attachment and ground contact case 50; said vehicle accessory power take-off/cigarette lighter receptacle attachment and ground contact case 50 is secured in a vehicle dashboard;

F. a vehicle accessory power take-off/faux element head 59 is received into and in mechanical and electrical continuity with a standard automotive cigarette lighter receptacle; said standard automotive cigarette lighter receptacle secured in a vehicle dashboard;

G. a quick connect phono type plug 74; receptacle means in the vehicle accessory power take-off/cigarette lighter 1 to receive in mechanical and electrical continuity the quick connect phono type plug 74;

H. an original equipment multi-receptacle junction box 100A having a plurality of phono plug connectors 102; the phono plug connectors 102 providing receptacle means to receive in mechanical and electrical continuity the quick connect phono type plug 74;

I. quick connect phono type plugs 74 adapted to provide electrical power to portable work and entertainment devices such as portable televisions, cellular telephones, computers and other such devices for use in and about automotive vehicles; said quick connect phono type plugs 74 to be received by means including phono plug connectors 102.

4. A Vehicle Accessory Power Take-Off System Including Phono/RCA Type Plug And Jack For Use With Cigarette Lighter Plug/Jack comprising:

A. a combination phono-jack type power take-off and cigarette lighter with a receptacle of special design providing for the continued presence of a functioning vehicle cigarette lighter combined with a power take-off feature to provide electrical power to a variety of electrically powered devices used in and about automotive vehicles;

B. a vehicle accessory power take-off/faux element head 59 received into and maintained in mechanical and electrical continuity with a standard vehicle cigarette lighter receptacle with means to provide electrical power to a variety of electrically powered devices used in and about automotive vehicles;

C. a quick-connect phono-type plug 74 which is electrically and mechanically received by the combination phono-jack type power take-off and cigarette lighter or the vehicle accessory power take-off/faux element head 59; the quick-connect phono-type plug 74 is adapted to the power cord of portable electrical or electronic devices by the consumer or original manufacturer in replacement of or as an alternative to the presently used cigarette lighter-type electrical connector for electrically powered devices used in and about an automotive vehicle;

D. a multi-receptacle non self-fused junction box, installed by a vehicle manufacturer as a part of the vehicle original equipment receiving electrical power from the electrical system of the vehicle and providing a plurality of phono plug connectors 102 receiving the quick-connect phono-type plug 74.

* * * * *